US009194183B2

(12) United States Patent
Stacy, II et al.

(10) Patent No.: US 9,194,183 B2
(45) Date of Patent: Nov. 24, 2015

(54) METHODS AND SYSTEMS FOR DRILLING BOREHOLES

(71) Applicant: Flanders Electric Motor Service, Inc., Evansville, IN (US)

(72) Inventors: Edward Curtis Stacy, II, Evansville, IN (US); Antonio Garcia, Pima, AZ (US)

(73) Assignee: Flanders Electric Motor Services, Inc., Evansville, IN (US)

( * ) Notice: Subject to any disclaimer, the term of this patent is extended or adjusted under 35 U.S.C. 154(b) by 0 days.

(21) Appl. No.: 14/045,553

(22) Filed: Oct. 3, 2013

(65) Prior Publication Data

US 2014/0027181 A1 Jan. 30, 2014

Related U.S. Application Data

(60) Continuation of application No. 13/524,608, filed on Jun. 15, 2012, now Pat. No. 8,567,523, which is a division of application No. 12/940,577, filed on Nov. 5, 2010, now Pat. No. 8,261,855, which is a continuation-in-part of application No. 12/616,399, filed on Nov. 11, 2009, now abandoned.

(51) Int. Cl.
*E21B 7/00* (2006.01)
*E21B 44/00* (2006.01)

(52) U.S. Cl.
CPC .. *E21B 7/00* (2013.01); *E21B 44/00* (2013.01)

(58) Field of Classification Search
CPC ..... E21B 44/00; E21B 21/08; E21B 44/005; E21B 44/02
USPC ..... 175/57, 24, 25, 50, 27
See application file for complete search history.

(56) References Cited

U.S. PATENT DOCUMENTS 2,310,001 A 2/1943 Haddock
3,381,761 A 5/1968 Hansson (Continued)

FOREIGN PATENT DOCUMENTS

AU 198423962 2/1984
AU 703002 7/1999

(Continued)

OTHER PUBLICATIONS

International Search Report mailed Jan. 10, 2011 for International Application No. PCT/US2010/055808, 2 pages.

(Continued)

*Primary Examiner* — Shane Bomar
*Assistant Examiner* — Wei Wang
(74) *Attorney, Agent, or Firm* — Chetlin IP, P.C.

(57) ABSTRACT

A system for drilling a borehole according to the present invention includes a control system and a drill rig, including a water injection system and an air injection system. The control system receives information from the drill rig that relates to at least one drill parameter. The control system processes information relating to the drill parameter, determines whether to implement a hole defect mitigation routine, including a drilling phase defect mitigation routine or a retraction phase defect mitigation routine following completion of the drilling phase. The control system determines whether the drill parameter is within a predetermined specification for the monitored drill parameter, chooses a hole defect mitigation routine based on the monitored drill parameter when the monitored drill parameter is outside the predetermined specification, and controls the drill rig to implement the chosen hole defect mitigation routine.

4 Claims, 16 Drawing Sheets

(56) References Cited

U.S. PATENT DOCUMENTS

| | | | | |
|---|---|---|---|---|
| 3,525,404 | A | 8/1970 | Newman et al. | |
| 3,561,542 | A | 2/1971 | Hanson et al. | |
| 3,613,805 | A | 10/1971 | Lindstad et al. | |
| 3,666,025 | A | 5/1972 | Hanson et al. | |
| 3,669,197 | A | 6/1972 | Hanson et al. | |
| 3,670,826 | A * | 6/1972 | Hanson et al. | 173/4 |
| 3,730,285 | A | 5/1973 | Anderson et al. | |
| 3,870,111 | A | 3/1975 | Tuomela et al. | |
| 4,074,771 | A | 2/1978 | Morrison | |
| 4,165,789 | A | 8/1979 | Rogers | |
| 4,182,588 | A | 1/1980 | Burkart et al. | |
| 4,334,580 | A | 6/1982 | Vann | |
| 4,354,233 | A | 10/1982 | Zhukovsky et al. | |
| 4,369,848 | A | 1/1983 | Salmi et al. | |
| 4,434,861 | A | 3/1984 | Howeth | |
| 4,503,918 | A | 3/1985 | Bergkvist et al. | |
| 4,793,421 | A | 12/1988 | Jasinski | |
| 4,794,534 | A | 12/1988 | Millheim | |
| 4,809,791 | A | 3/1989 | Hayatdavoudi | |
| 4,852,399 | A | 8/1989 | Falconer | |
| 5,048,620 | A | 9/1991 | Maher | |
| 5,125,460 | A | 6/1992 | Behrens | |
| 5,348,106 | A | 9/1994 | Mattero | |
| 5,358,058 | A | 10/1994 | Edlund et al. | |
| 5,445,229 | A | 8/1995 | Delima | |
| 5,449,047 | A | 9/1995 | Schivley, Jr. | |
| 5,465,798 | A | 11/1995 | Edlund et al. | |
| 5,474,142 | A | 12/1995 | Bowden | |
| 5,540,292 | A | 7/1996 | Behrens | |
| 5,771,981 | A * | 6/1998 | Briggs et al. | 173/4 |
| 5,844,133 | A * | 12/1998 | Goto et al. | 73/152.54 |
| 5,913,371 | A | 6/1999 | Jenne | |
| 6,021,377 | A | 2/2000 | Dubinsky et al. | |
| 6,152,246 | A | 11/2000 | King et al. | |
| 6,209,661 | B1 | 4/2001 | Muona | |
| 6,209,662 | B1 * | 4/2001 | Stahl | 175/27 |
| 6,216,800 | B1 | 4/2001 | Wilson et al. | |
| 6,253,860 | B1 | 7/2001 | Poysti et al. | |
| 6,439,322 | B2 | 8/2002 | Beck, III | |
| 6,637,522 | B2 * | 10/2003 | Wilson et al. | 175/25 |
| 6,662,110 | B1 | 12/2003 | Bargach et al. | |
| 6,866,106 | B2 | 3/2005 | Trueman et al. | |
| 6,868,920 | B2 | 3/2005 | Hoteit et al. | |
| 6,938,702 | B2 | 9/2005 | Saha et al. | |
| 7,048,077 | B2 | 5/2006 | Veres | |
| 7,090,037 | B2 | 8/2006 | Best | |
| 7,198,117 | B2 | 4/2007 | Uitto | |
| 7,228,899 | B2 | 6/2007 | Newman et al. | |
| 7,243,735 | B2 | 7/2007 | Koederitz et al. | |
| 7,350,593 | B1 | 4/2008 | Brookover | |
| 7,422,076 | B2 | 9/2008 | Koederitz et al. | |
| 7,464,772 | B2 | 12/2008 | Hall et al. | |
| 7,604,070 | B2 | 10/2009 | Kemppainen | |
| 7,651,301 | B2 | 1/2010 | Taniguchi et al. | |
| 7,694,752 | B2 | 4/2010 | Daniel et al. | |
| 7,717,190 | B2 | 5/2010 | Keskiniva et al. | |
| 7,721,816 | B1 | 5/2010 | Wilson et al. | |
| 7,762,346 | B2 | 7/2010 | Jonsson | |
| 7,762,352 | B2 | 7/2010 | Pettersson | |
| 7,828,083 | B2 | 11/2010 | Sormunen et al. | |
| 7,954,558 | B2 | 6/2011 | Lane et al. | |
| 8,136,612 | B2 | 3/2012 | Carlson et al. | |
| 8,146,680 | B2 | 4/2012 | Mock et al. | |
| 8,210,283 | B1 | 7/2012 | Benson et al. | |
| 8,261,855 | B2 | 9/2012 | Stacy, II et al. | |
| 8,261,856 | B1 | 9/2012 | Stacy, II et al. | |
| 2001/0050186 | A1 | 12/2001 | Wilson et al. | |
| 2002/0074165 | A1 | 6/2002 | Lee et al. | |
| 2003/0056983 | A1 | 3/2003 | Alft et al. | |
| 2004/0040746 | A1 | 3/2004 | Niedermayr et al. | |
| 2005/0193811 | A1 | 9/2005 | Bilby et al. | |
| 2005/0279532 | A1 | 12/2005 | Ballantyne et al. | |
| 2006/0272861 | A1 | 12/2006 | Hutchinson | |
| 2007/0003382 | A1 | 1/2007 | Hinshaw et al. | |
| 2007/0007039 | A1 | 1/2007 | Noel | |
| 2007/0185696 | A1 | 8/2007 | Moran et al. | |
| 2007/0242565 | A1 | 10/2007 | Hall et al. | |
| 2008/0000688 | A1 | 1/2008 | McLoughlin et al. | |
| 2008/0060851 | A1 | 3/2008 | Taniguchi et al. | |
| 2008/0271923 | A1 | 11/2008 | Kukso et al. | |
| 2009/0090555 | A1 | 4/2009 | Boone et al. | |
| 2009/0126994 | A1 | 5/2009 | Tibbitts et al. | |
| 2009/0132458 | A1 | 5/2009 | Edwards et al. | |
| 2009/0173540 | A1 | 7/2009 | Mock et al. | |
| 2009/0266608 | A1 | 10/2009 | Jeffryes | |
| 2010/0044104 | A1 | 2/2010 | Zediker et al. | |
| 2011/0108323 | A1 | 5/2011 | Stacy, II | |
| 2011/0108324 | A1 | 5/2011 | Stacy, II et al. | |
| 2012/0097449 | A1 | 4/2012 | Viitaniemi et al. | |
| 2012/0118637 | A1 | 5/2012 | Wang et al. | |
| 2012/0186873 | A1 | 7/2012 | Shayegi et al. | |
| 2012/0253518 | A1 | 10/2012 | Stacy, II et al. | |
| 2012/0253519 | A1 | 10/2012 | Stacy, II et al. | |
| 2012/0255775 | A1 | 10/2012 | Stacy, II et al. | |

FOREIGN PATENT DOCUMENTS

| | | | |
|---|---|---|---|
| AU | 2009222482 | B2 | 7/2012 |
| AU | 2009300240 | | 6/2013 |
| GB | 1437442 | | 5/1974 |
| WO | 2007138170 | A1 | 12/2007 |
| WO | 2009002306 | A1 | 12/2008 |
| WO | 2009029269 | A2 | 3/2009 |
| WO | 2010042050 | A1 | 4/2010 |

OTHER PUBLICATIONS

Written Opinion of the International Searching Authority mailed Jan. 10, 2011 for International Application No. PCT/US2010/055808, 7 pages.

"Motor Operations Manual," Fourth Edition (4.3), Published 2005, 132 pages, Cavo Drilling Motors, 2450 Black Gold Ct., Houston, TX 77073, USA.

Glass, B. et al., "DAME: Planetary-Prototype Drilling Automation," Presented at 2007 NASA Science Technology Conference (NSTC2007), Jun. 19-21, 2007, 8 pages, University of Maryland University College, U.S.A., Published online at: http://esto.nasa.gov/conferences/nstc2007/papers/Glass_Brian_C2P1_NSTC-7-0102.pdf.

"Operator Training Manual—SKSS-15-Blast-hole Drill Rig," Published Mar. 2004, 130 pages, Reedrill Australia Limited.

"Power Performance Drill Upgrades-TorqReg/Digital Drives Upgrade-ARDVARC (Advanced Rotary Drill Vector Automated Radio Control," Nov. 20, 2008, 43 pages, Flanders ElectricPresentation at the Western Mining Electrical Association Conference, Denver, CO, U.S.A.

Fiscor, Steve, "Fully Automated Blasthole Drilling Becomes a Reality," Dec. 10, 2009, 7 pages, Engineering and Mining Journal&MJ News.

Grad, Paul S., "Running with Robotics, Step by Step, Rio Tinto's concept of highly autonomous mining is Materializing in Western Australia's Pilbara iron ore district," Published Feb. 26, 2010, 5 pages, World of Mining Professionals (WOMP), The Mining E-Journal Published in Association with Engineering and Mining Journal (E&MJ), 2010, vol. 1-February.

"Surface Drilling," Manual, 4th Edition, Published 2008, pp. 3-12, 51-54, and 79-80, Atlas Copco AB, SE-105 23, Stockholm Sweden, www.surfacedrilling.com.

"ROC F9C System Description, PMI NR: 9853 1121 01b," Manual, Published 2008, 102 pages, Atlas Copco Rock Drills AB, SE-105 23, Stockholm, Sweden.

"Blasthole Drilling in Open Pit Mining," First edition, Published 2009, pp. 25-30 and 170-175, Atlas Copco AB, SE-105 23, Stockholm, Sweden. www.atlascopco.com/blastholedrills.

"Rotary Blasthole Drilling Air Practices Handbook," Published 2004, 36 pages, Atlas Copco BHMT Inc., P.O. Box 531226, Grand Prairie, Texas, USA 75053-12226.

Zink, Jr., Clarence R., Manager-Field Engineering, Baker Hughes Mining tools, Inc., Grand Prairie, Texas, "Bottom Hole Annular Pressure: A Theoretical Problem with Real Effects," Published Feb.

(56) References Cited

OTHER PUBLICATIONS 8-11, 1998, 24th Annual Conference on Explosives and Blasting Technique and 14th Annual Symposium on Explosives and Blasting Research, New Orleans, Louisiana, 18 pages, International Society of Explosive Engineers.

Australian Drilling Manual, Third Edition, ISBN 0 949279 20 X, Published 1992, 56 pages, Australian Drilling Industry Training Committee Limited.

"Military Well Drilling Field Manual," Part Two. Well Drilling, Chapter 5, "Well Drilling Methods," Stored on the Internet Archive Wayback Machine on Apr. 2, 2009, 42 pages, http://www.globalsecurity.org/military/library/policy/army/fm15-484/CH5.htm.

Statement of Grounds and Particulars, In the Matter of Australian Patent Application No. 2010319730, Flanders Electric Motor Service, Inc. and Opposition thereto by Christopher John Carter, dated Jun. 11, 2015, amended Jun. 23, 2015, 14 pages.

* cited by examiner

METHODS AND SYSTEMS FOR DRILLING BOREHOLES

CROSS-REFERENCE TO RELATED APPLICATIONS

This application is continuation of U.S. patent application Ser. No. 13/524,608, filed on Jun. 15, 2012, which is a divisional of U.S. patent application Ser. No. 12/940,577, filed on Nov. 5, 2010, now U.S. Pat. No. 8,261,855, issued on Sep. 11, 2012, which is a continuation-in-part of U.S. application Ser. No. 12/616,399, filed Nov. 11, 2009, now abandoned, all of which are incorporated herein by reference for all that they disclose.

TECHNICAL FIELD

This invention relates to methods and systems for drilling boreholes in general and more specifically to methods and systems for drilling blastholes of the type commonly used in mining and quarrying operations.

BACKGROUND

Various systems and methods for drilling boreholes are known in the art and have been used for decades in a wide variety of applications, from oil and gas, to mining, to quarrying operations, just to name a few. In mining and quarrying operations, such boreholes are typically filled with an explosive that, when detonated, ruptures or fragments the surrounding rock. Thereafter, the fragmented material can be removed and processed in a manner consistent with the particular operation. When used for this purpose, then, such boreholes are commonly referred to as "blastholes," although the terms may be used interchangeably.

A number of factors influence the effectiveness of the blast, including the nature of the geologic structure (i.e., rock), the size and spacing of the blastholes, the burden (i.e., distance to the free face of the geologic structure), the type, amount, and placement of the explosive, as well as the order in which the blastholes are detonated. Generally speaking, the size, spacing, and depth of the blastholes represent the primary means of controlling the degree of rupture or fragmentation of the geologic structure, and considerable effort goes into developing a blasthole specification that will produce the desired result. Because the actual results of the blasting operation are highly correlated with the degree to which the actual blastholes conform to the desired blasthole specification, it is important to ensure that the actual blastholes conform as closely as possible to the desired specification.

Unfortunately, however, it has proven difficult to form or drill blastholes that truly conform to the desired specification. First, a typical blasting operation involves the formation several tens, if not hundreds, of blastholes, each of which must be drilled in proper location (i.e., to form the desired blasthole pattern) and to the proper depth. Thus, even where it is possible to achieve a relatively high hole compliance rate (i.e., the percentage of blastholes that comply with the desired specification), the large number of blastholes involved in a typical operation means that a significant number of blastholes nevertheless may fail to comply with the specification. In addition, even where blastholes are drilled that do comply with the desired specification, a number of post-drilling events, primarily cave-ins, can make a blasthole non-compliant. Indeed, such post-drilling events can be major contributors to blasthole non-compliance.

Still further, because of the large number of blastholes that are typically required for a single blasting operation, methods are constantly being sought that will allow the blastholes to be formed or drilled as rapidly as possible. As with most endeavors, however, there is an inverse relationship between speed and quality, and systems that work to increase speed at which a series of blastholes can be drilled usually come at the expense of hole quality. Consequently, there is a need for methods and systems for forming blastholes that will ensure consistent blasthole quality while minimizing the adverse affects on the speed of blasthole formation.

SUMMARY OF THE INVENTION

A system for drilling a borehole according to one embodiment of the present invention may include a drill rig and a control system. The drill rig includes a drill, an air injection system and a water injection system. The control system controls the drill, air injection system and water injection system and receives information from the drill rig that relates to at least one drill parameter. The control system stores program steps and processes information relating to the drill parameter, determines whether the drill parameter is within a predetermined specification for the monitored drill parameter and chooses a hole defect mitigation routine based on the monitored drill parameter when the monitored drill parameter is outside the predetermined specification. The hole defect mitigation routine includes a drilling phase mitigation routine for implementation during a drilling phase and as retraction phase mitigation routine for implementation during a retraction phase. The control system controls the drill rig to implement the chosen hole defect mitigation routine.

In another embodiment of the system of the present invention, the drilling phase defect mitigation routine may include one or more selected from the group consisting of rotary stall protection, end-of-hole spin-out, and end-of-hole water control, and the control system monitors one or more drill parameters selected from the group consisting of air pressure, drill rotational speed, drill torque, drill depth, and number of drill retractions.

In one embodiment, a method for drilling a borehole may include the steps of: Monitoring a drill parameter during a drilling phase and a retraction phase, the retraction phase beginning after the borehole has been drilled or after performing an end-of-hole measurement routine; using the monitored drill parameter to draw a conclusion about a borehole characteristic; choosing a defect mitigation routine based on the borehole characteristic; and implementing the defect mitigation routine.

BRIEF DESCRIPTION OF THE DRAWINGS

Illustrative and presently preferred exemplary embodiments of the invention are shown in the drawings in which.

DETAILED DESCRIPTION OF THE PREFERRED EMBODIMENTS

Figure 1:
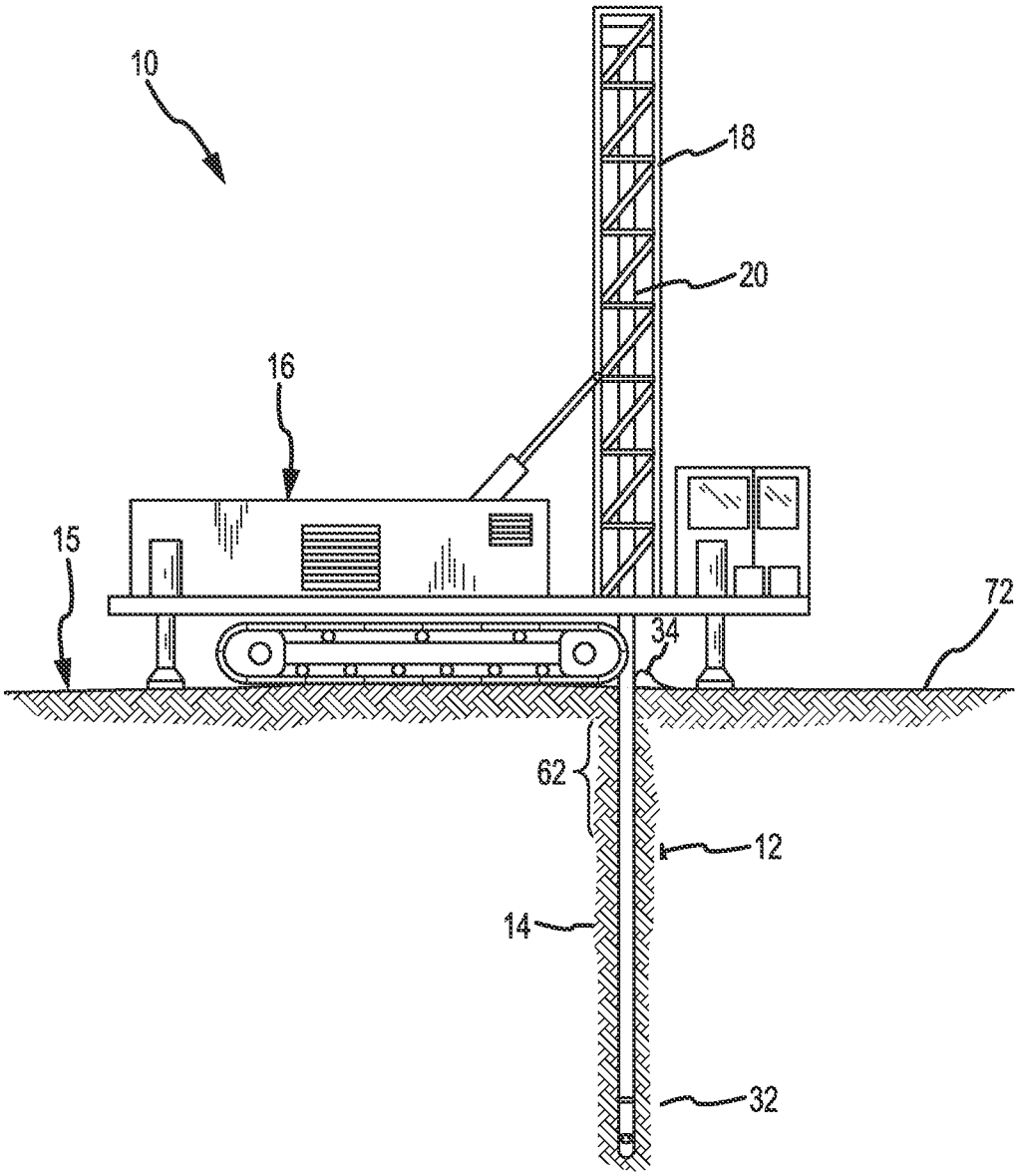
FIG. 1 is a side view in elevation of a blasthole drill rig embodying the systems and methods of the present invention.

One embodiment of a system 10 for forming or drilling a borehole 12 is shown and described herein as it could be used to form blastholes 14 of the type commonly used in mining and quarrying operations. After the system 10 has been used to drill or form a plurality of blastholes 14 in the desired pattern, the various blastholes 14 are then filled with an explosive material (not shown). The subsequent detonation of the explosive material ruptures or fragments the geologic structure 15, which may then be collected and processed in a manner consistent with the intended application (e.g., mining or quarrying, as the case may be).

Briefly, the system 10 of the present invention increases the quality of boreholes 12, i.e., the percentage of boreholes 12 that comply with the desired borehole specification. Significantly, the present invention not only increases initial hole quality, i.e., immediately after the boreholes 12 are drilled, but also long-term hole quality, i.e., the percentage of boreholes 12 that remain in compliance after they have been formed. That is, boreholes 12 that are formed in accordance with the teachings of the present invention are less subject to cave-ins and other post-drilling events that would otherwise make compliant boreholes 12 non-compliant.

The present invention increases both initial and long-term borehole quality by monitoring one or more drill parameters while the boreholes 12 are being formed or drilled. The monitored drill parameter(s) is compared with a predetermined specification for the parameter(s). If the monitored drill parameter is outside the specification, the present invention selects and implements one or more defect mitigation routines to ensure that the borehole 12 is drilled to the desired specification. Significantly, the defect mitigation routine(s) also helps to ensure that the borehole 12 remains compliant even after it has been drilled. Explained another way, the system 10 uses the monitored drill parameter to draw a conclusion about one or more borehole characteristics. The system then chooses the mitigation routine that will most effectively mitigate or compensate for the particular borehole characteristic. Consequently, the present invention allows for a significant increase in the number of boreholes 12 that are compliant with the particular borehole specification, both on an initial and long-term basis.

Figure 2:
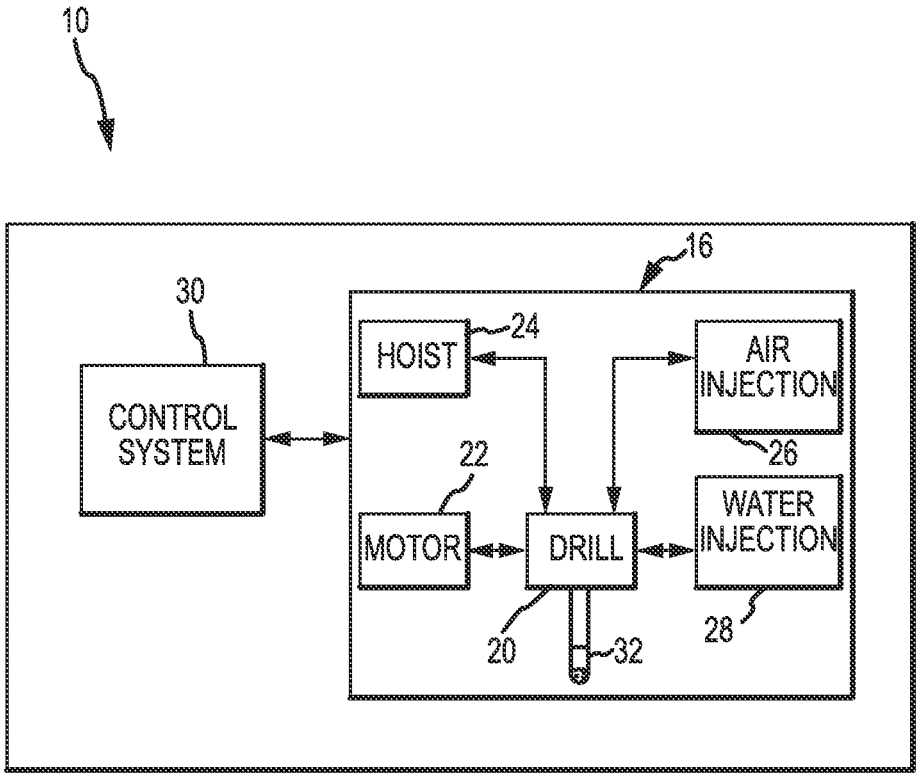
FIG. 2 is a schematic representation of a blasthole drilling system according to one embodiment of the present invention.

Referring now to FIGS. 1 and 2 simultaneously, in one embodiment the system 10 may comprise a drill rig 16 having a mast or derrick 18 configured to support a drill string 20 having a drill bit 32 provided on the end thereof. Drill rig 16 may also be provided with various systems for operating the drill string 20 to form boreholes 12 (e.g., blastholes 14). For example, in the embodiments shown and described herein, drill rig 16 may also comprise a drill motor system 22, a drill hoist system 24, an air injection system 26, and a water injection system 28, as best seen in FIG. 2. The system 10 of the present invention may also comprise a control system 30 that is operatively associated with the drill rig 16, as well as the various systems thereof, e.g., motor system 22, hoist system 24, air injection system 26, and water injection system 28. As will be explained in much greater detail below, control system 30 monitors various drill parameters generated or produced by the various drill systems and controls them as necessary to form the blasthole 14. In doing so, control system 30 may also implement the various hole defect mitigation routines 40 and 42 (FIGS. 4 and 5) in order to improve blasthole quality.

As its name implies, drill motor system 22 is connected to the drill string 20 and may be operated by control system 30 to provide a rotational force or torque to rotate the drill bit 32 provided on the end of the drill string 20. Control system 30 may operate drill motor system 22 so that the drill bit 32 rotates in either the clockwise or counterclockwise directions. Drill motor system 22 may also be provided with various sensors and transducers (not shown) to allow the control system 30 to monitor or sense the rotational force or torque applied to the drill bit 32, as well as the rotational speed and direction of rotation of the drill bit 32.

Drill hoist system 24 is also connected to the drill string 20 and may be operated by control system 30 to raise and lower drill bit 32. As was the case for the drill motor system 22, the drill hoist system 24 may also be provided with various sensors and transducers (not shown) to allow the control system 30 to monitor or sense the hoisting forces applied to the drill string 20 as well as the vertical position or depth of the drill bit 32.

The air injection system 26 of drill rig 16 is operatively connected to drill string 20 and may be operated by control system 30 to provide high pressure air to the drill string 20. The high pressure air from air injection system 26 is directed through a suitable conduit (not shown) provided in drill string 20 and ultimately exits the drill string 20, typically though one or more openings (not shown) provided in drill bit 32. The high pressure air from air injection system 26 is primarily used to assist in the bailing or removal from the borehole 12 of cuttings 34 dislodged by the rotating drill bit 32. However, and as will be described in further detail herein, the system and method of the present invention may use the high pressure air for other purposes as well.

As was the case for the other systems of drill rig 16, the air injection system 26 may be provided with various sensors and transducers (not shown) to allow the control system 30 to monitor or sense various drill parameters relating to the function and operation of the air injection system 26.

The water injection system 28 of drill rig 16 is also operatively connected to the drill string 20. Control system 30 may operate the water injection system 28 to provide a drilling fluid, such as water, to the drill bit 32. More specifically, pressurized water from the water injection system 28 is directed through a suitable conduit or passageway (not shown) provided in drill string 20, whereupon it ultimately exits the drill string 20, typically through one or more openings (not shown) provided in drill bit 32. The water (or other drilling fluid) from water injection system 28 is primarily used to assist in the removal of cuttings 34 from borehole 12. However, the system and method of the present invention may also use the water injection system 28 for other purposes as well, as will be described in greater detail herein.

The water injection system 28 may also be provided with various sensors and transducers (not shown) to allow the control system 30 to monitor or sense various drill parameters relating to the function and operation of the water injection system 28.

As mentioned, the control system 30 is operatively connected to various systems and devices of drill rig 16 and receives information (e.g., drill parameters) from the various systems and devices of drill rig 16 in the manner described herein. In addition, control system 30 also stores program steps for program control, processes data, chooses or selects one or more hole defect mitigation routines (e.g., 40 and 42), and implements those routines by the appropriate control of the various systems and devices of drill rig 16.

Figure 3:
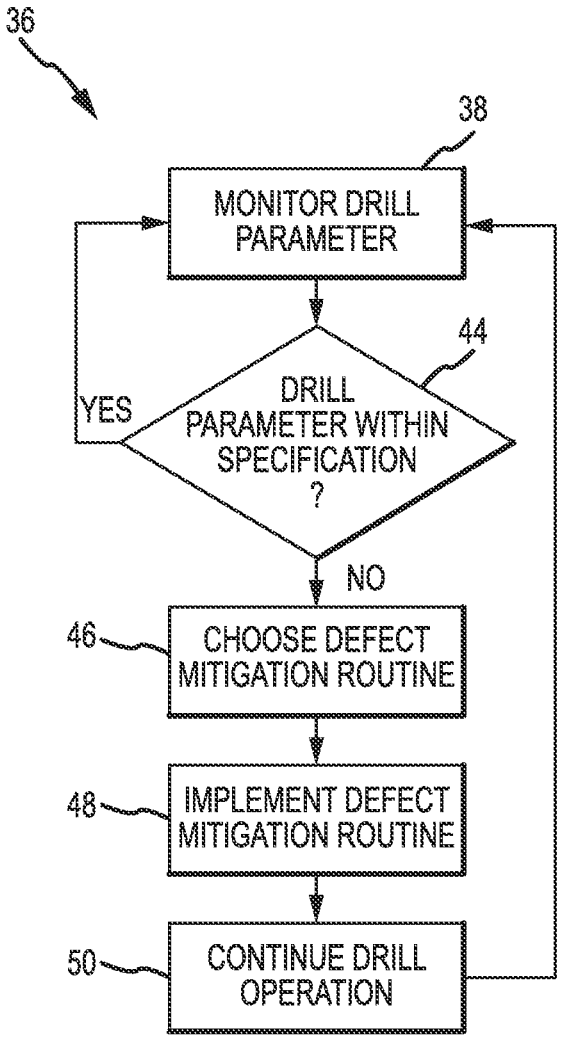
FIG. 3 is a flow chart of one embodiment of a method for drilling blastholes.
Figure 4:
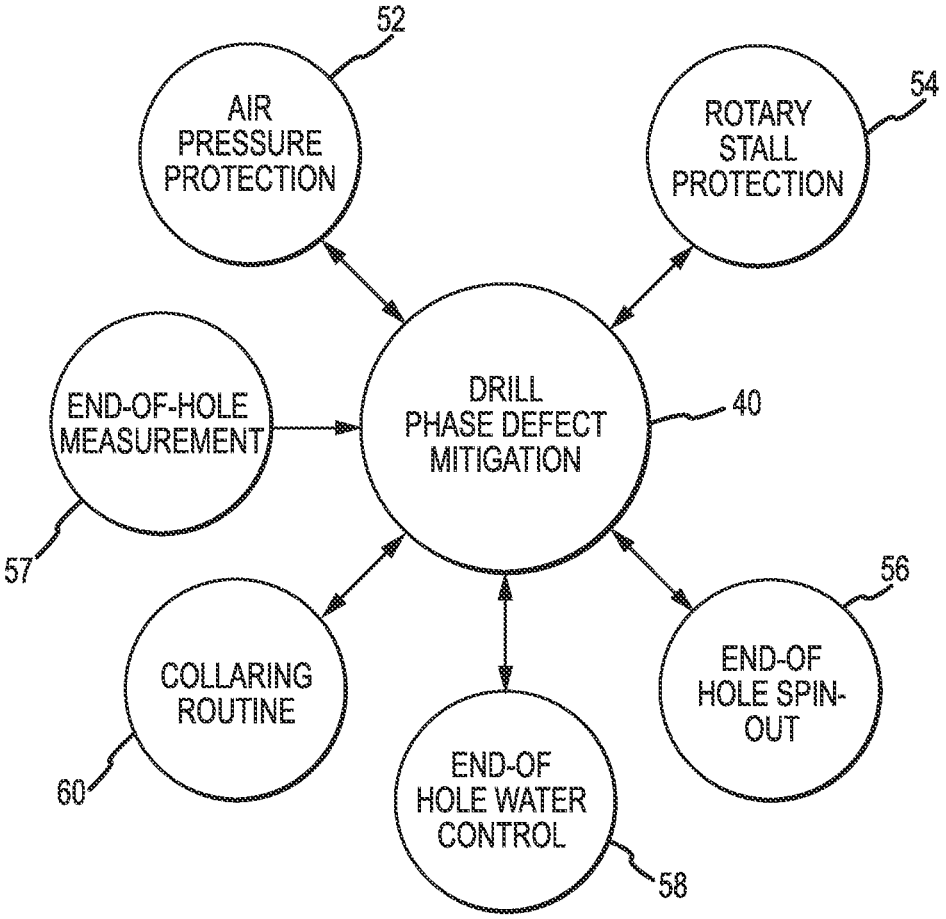
FIG. 4 is a schematic representation of drilling phase mitigation routines.
Figure 5:
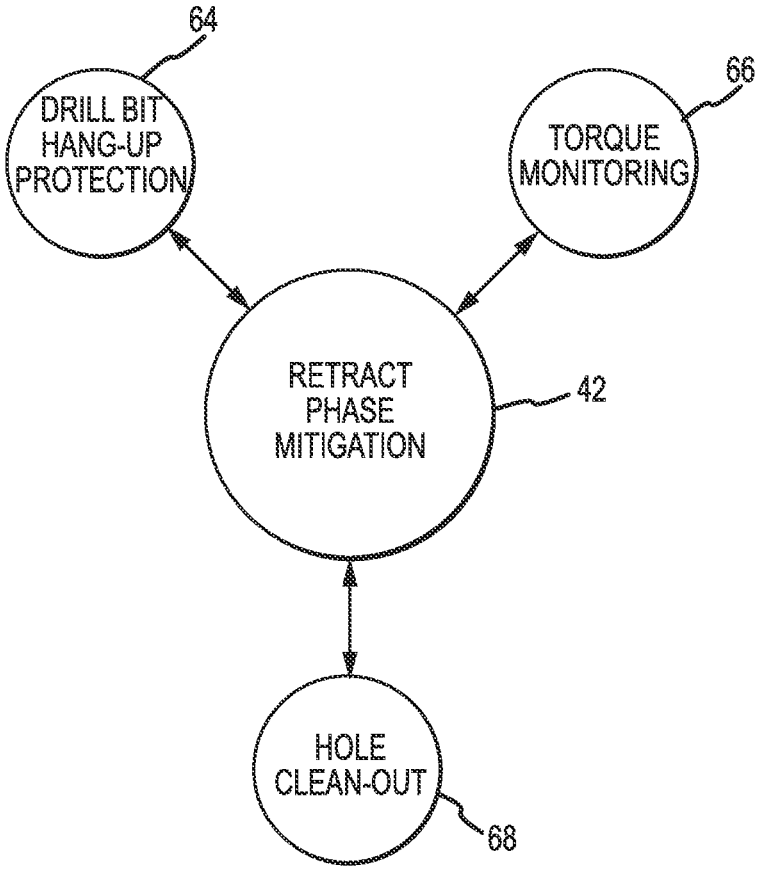
FIG. 5 is a schematic representation of retraction phase mitigation routines.

Referring now to FIGS. 3-5 simultaneously, control system 30 may be programmed to implement a method 36 for drilling the boreholes 12 in accordance with the teachings provided herein. Briefly, in a first step 38 of method 36, the control system 30 monitors one or more drill parameters associated with the operation of drill rig 16 and the various systems thereof. As will be described in greater detail below, the particular drill parameters that are monitored by control system 30 may differ depending on whether the drill rig 16 is being operated in a drilling phase (i.e., in which the drill bit 32 is being advanced or driven into the geologic structure 15 to form borehole 12) or in a retraction phase (i.e., in which the drill bit 32 is being withdrawn from borehole 12). Similarly, the particular defect mitigation routine or routines that may be implemented by control system 30 may differ depending on whether the drill rig 14 is being operated in the drilling phase or the retraction phase.

For example, if drill rig 16 is being operated in the drilling phase, control system 30 may select and implement one or more drilling phase defect mitigation routines 40, as best seen in FIG. 4. Alternatively, control system 30 may select and implement one or more retraction phase defect mitigation routines 42 when the drill rig 16 is being operated in the retraction phase. See FIG. 5.

Referring back now to FIG. 3, if the various drill parameters monitored by the control system 30 are within specifications for the various drill parameters, as determined during step 44, then control system 30 takes no further action, other than to continue to operate the drill rig 16 to form blasthole 14. That is, control system 30 will simply continue to monitor the various drill parameters at step 38 as the drilling operation proceeds. If, however, control system 30 determines that one or more of the drill parameters are not in accordance with the specified drill parameters, then control system 30 proceeds to step 46, wherein control system 30 chooses or selects a defect mitigation routine, e.g., either a drilling phase defect mitigation routine 40 or a retraction phase defect mitigation routine 42, as the case may be.

Once the particular defect mitigation routine has been selected, i.e., at step 46, control system 30 will then implement the particular defect mitigation routine at step 48. Control system 30 implements the particular defect mitigation routine by operating the various systems of drill rig 14 in accordance with the teachings provided herein. After the particular defect mitigation routine has been implemented, the control system 30 will continue to operate the drill rig 16 in accordance with the particular phase (e.g., the drilling phase or the retraction phase) at step 50.

The system 10 may be operated as follows to cause the drill rig 16 to drill a borehole 12, such as a blasthole 14, in a geologic structure 15 (i.e., the ground). Once the drill rig 16 has been properly positioned, i.e., so that borehole 12 will be drilled at the desired location, the control system 30 may initiate the drilling phase of operation. During the drilling phase, the control system 30 operates the drill motor 22, drill hoist 24, air injection system 26, and water injection system 28 to begin rotating and driving the drill bit 32 into the ground or geologic formation 15. During the drilling phase, the control system 30 monitors (i.e., at step 38) the various drill parameters that are generated or produced by the various systems comprising drill rig 16.

As will be described in greater detail below, certain drill parameters are indicative of certain issues during drilling that, if properly managed, can mitigate or lessen the possible adverse effects such issues may have on borehole quality. For example, during the drilling phase, the control system 30 may monitor drill parameters such as air pressure, drill rotational speed, drill torque, drill depth, and the number of times the drill has been retracted during the drilling phase. The control system 30 compares these various drill parameters with predetermined specifications for the respective parameters. If one or more of the drill parameters is outside the predetermined specification, the control system 30 chooses and implements one or more drilling phase defect mitigation routines 40, as best seen in FIG. 4. The various drilling phase defect mitigation routines 40 comprise an air pressure protection routine 52, a rotary stall protection routine 54, an end-of-hole spin-out routine 56, an end-of-hole measurement routine 57, and an end-of-hole water control routine 58.

In addition, the drilling phase defect mitigation routines 40 may also comprise a collaring routine 60. In the embodiments shown and described herein, the collaring routine 60 is automatically performed at the start of each borehole 12. That is, in one embodiment, the selection and implementation of the collaring routine 60 is not dependent on whether or not any drill parameter is within the predetermined specification. The collaring routine 60 creates a high quality collar 62 (e.g., the first 1-3 meters of the borehole 12).

Briefly described, the air pressure protection routine 52 detects a failing borehole 12 by monitoring the air pressure at the drill bit 32. If the air pressure exceeds the predetermined specification, then the drill bit 32 is retracted to clear the obstruction in the borehole 12. The rotary stall protection routine 54 is useful in detecting fractures or broken-up ground being engaged by the drill bit 32. That is, when the drill bit 32 encounters broken or unstable ground, the bit 32 will typically stall out (i.e., cease to rotate). The rotary stall protection routine 54 detects these stalls and retracts the drill bit 32 to allow it to rotate again. The end-of-hole spin-out routine 56 monitors the number of times the bit 32 needs to be retracted from the borehole 12 during the drilling phase and uses that number as a basis for determining how long to spend at the bottom of the borehole 12 clearing out any cuttings 34 before retracting the bit 32 from the borehole 12. The end-of-hole measurement routine 57 may be used to confirm that the borehole 12 will drilled to the prescribed depth. The end-of-hole water control routine 58 deactivates the water injection system 28 to allow the dry cuttings 34 being created without water injection to build up a coating on the inside of the borehole 12. The coating helps to reduce the amount of cuttings 34 that can fall back into the borehole 12 as the drill bit 32 is subsequently retracted.

The control system 30 may also utilize a variety of retraction phase mitigation routines 42 (FIG. 5) during the retraction phase of drilling, i.e., when the drill bit 32 is being retracted from the borehole 12. In the embodiments shown and described herein, the retraction phase mitigation routines 42 comprise a drill bit hang-up protection routine 64, a torque monitoring routine 66, and a hole clean-out routine 68. See FIG. 5. The control system 30 selects or chooses from among the various retraction phase defect mitigation routines 42 based on one or more monitored drill parameters consisting of drill rotational speed, drill torque, hoist speed, and number of drill retractions.

For example, when retracting the rotating drill string 20 from the borehole 12, the control system 30 monitors the hoist speed as well as the rotation speed and torque applied to drill bit 32. If these drill parameters are out of specification, the control system 30 will implement the drill bit hang-up protection routine 64 to free the bit and implement the hole clean-out routine 68. The torque monitoring routine 66 detects bad spots in the borehole 12 by monitoring the torque applied to the rotating drill bit 32 as the bit 32 is withdrawn from the borehole 12. If the torque exceeds or is outside the predetermined torque parameter, the control system 30 will implement the hole clean-out routine 68. The hole clean-out routine 68 involves re-lowering the drill bit 32 to the bottom of the borehole 12, where the spin-out routine 56 is applied. The bit 32 will then be retracted once again.

A significant advantage of the present invention is that may be used to produce high quality boreholes 12, i.e., boreholes 12 that are compliant with the desired borehole specification. Moreover, not only is initial hole quality increased, i.e., the percentage of boreholes that are compliant with the desired specification immediately after formation, but long-term hole quality is increased as well. That is, the various defect mitigation routines help to minimize the likelihood that post-drilling events, such as cave-ins, will cause otherwise compliant blastholes 14 to become non-compliant before they can be filled with explosives.

Still other advantages are associated with the present invention. For example, by monitoring the drill parameters as the borehole 12 is being formed, the present invention is able to implement the various defect mitigation routines 40 and 42 on an as-needed basis. That is, the various defect mitigation routines are not automatically implemented on every borehole 12. The selective implementation of the various defect mitigation routines 40 and 42 allows the boreholes 12 to be formed as rapidly as possible, while still allowing for the formation of high quality boreholes 12. Stated another way, the various hole defect mitigation routines 40 and 42 are only implemented when they are needed, e.g., due to defects in the geologic structure 15. They are not implemented in areas where the geologic structure 15 will allow the formation of high quality boreholes without the need to implement any defect mitigation routines.

Yet another advantage of the present invention is that it selects and applies different hole defect mitigation routines depending on the type of defects that are encountered during drilling. The present invention is thus able to apply the defect mitigation routine that is most appropriate for addressing the particular defects in the geologic structure 15 that are encountered when drilling each particular borehole 12.

Still yet other advantages are associated with the collaring routine 60. For example, by implementing the collaring routine 60 on every borehole 12, i.e., regardless of whether the monitored drill parameters are within specification, the present invention maximizes both initial and long-term borehole quality. The quality of the hole collar 12 will always be uniformly high.

Having briefly described the system and method for forming boreholes according to the present invention, as well as some of its more significant features and advantages, various exemplary embodiments of the invention will now be described in detail. However, before proceeding with the description, it should be noted that the various embodiments of the present invention are shown and described herein as they could be implemented on a conventional semi-automated blasthole drill rig 16 of the type commonly used in mining and quarrying operations to drill boreholes suitable for blasting. However, it should be understood that the present invention could be implemented or practiced on other types of drill rigs that are now known in the art or that may be developed in the future that are, or would be, suitable for drilling such boreholes.

Of course, the present invention may also be used in other applications besides mining and quarrying operations. Indeed, the present invention could be used in any application wherein it would be desirable to form boreholes of consistent quality or otherwise compensate for variations in the geologic structure in which the boreholes are formed. Consequently, the present invention should not be regarded as limited to the particular devices, systems, and applications shown and described herein.

Referring back now to FIGS. 1-3 simultaneously, in one embodiment, the system 10 for forming boreholes 12 is shown and described herein as may be used to drill or form a plurality of boreholes 12 of the type used in open-pit mining operations. After being drilled or formed, the various boreholes 12 are filled with an explosive material that, when detonated, ruptures or fractures the geologic structure 15. The fractured material may then be removed and processed to recover the valuable mineral content.

In this particular application, the drill rig 16 that is used to form the blastholes 14 comprises a mast or derrick 18 that is configured to support the drill string 20 that is used to drill or form the blastholes 14. Drill rig 16 may also comprise various other systems, such as a drill motor system 22, a drill hoist system 24, an air injection system 26, and a water injection system 28, required to operate the drill string 20 to form the blastholes 14. A control system 30 operatively connected to drill rig 16 and the various systems comprising drill rig 16 monitors drill parameters and controls the various systems in the manner described herein.

Drill rig 16 will also comprise a number of additional systems and devices, such as one or more power plants, electrical systems, hydraulic systems, pneumatic systems, etc. (not shown), that may be required or desired for the operation of the particular drill rig 16. However, because such additional systems and devices are well known in the art and are not required to understand or implement the present invention, such additional systems and devices that may be utilized in any particular drill rig 16 will not be described in further detail herein.

Referring now primarily to FIGS. 1 and 2, drill motor system 22 is operatively connected to drill string 20 and provides the rotational force or torque required to rotate drill bit 32 mounted on the end of drill string 20. Typically, drill motor system 22 will comprise an electrically- or hydraulically-powered system that is reversible so that the drill bit 32 can be rotated in either the clockwise or counterclockwise direction.

In most drill rigs, the drill motor system 22 is capable of automatic or semi-automatic operation, and will usually be provided with various sensors and transducers (not shown) suitable for sensing and producing output signals or data relating to various aspects and operational states of the drill motor system 22. For example, in the embodiment shown and described herein, drill motor system 22 is provided with sensors or transducers suitable for allowing the control system 30 to monitor the torque applied to drill bit 32, as well as the rotational speed and rotational direction of drill bit 32. Generally speaking, most drill rigs will already be provided with sensors or transducers suitable for providing the required drill parameter data to control system 30. If not, suitable sensors or transducers would need to be provided. Finally, it should be noted that because drill motors for drill rigs are well-known in the art, and because a more detailed description of such drill motor systems 22 is not required to understand or practice the invention, the particular drill motor system 22 that may be utilized in conjunction with the present invention will not be described in further detail herein.

Drill rig 16 may also be provided with a drill hoist system 24 that is also operatively associated with the drill string 20 and control system 30, as best seen in FIG. 2. The drill hoist system 24 applies axial or hoisting forces to the drill string 20 to raise and lower the drill bit 32. The drill hoist system 24 may be electrically or hydraulically powered and may be configured to apply axial forces to the drill string 20 in both directions, i.e., to provide both "pull-up" (i.e., retraction) and "pull-down" (i.e., extension) forces to the drill bit 32.

In most cases, the drill hoist system 24 is also capable of automatic or semi-automatic operation and may be provided with various sensors and transducers (not shown) suitable for sensing and producing signals relating to various aspects and operational states of the drill hoist system 24. In the various embodiments shown and described herein, the control system 30 monitors hoisting forces (e.g., both pull-up and pull-down forces) applied to drill string 20, as well as the vertical position or depth of the drill bit 32. Consequently, the drill hoist system 24 should be capable of providing such information to the control system 30. If not, suitable sensors or transducers would need to be provided.

The air injection system 26 of drill rig 16 is operatively connected to the drill string 20 and provides high-pressure air to the drill string 20. The high-pressure air from air injection system 26 is directed through a suitable conduit (not shown) provided in the drill string 20, and ultimately exits through one or more openings provided in the drill bit 32. As described above, the control system 30 of the present invention is operatively connected to the air injection system 26 so that it can control the operation thereof. In addition, control system 30 also monitors the air pressure provided to the drill string 20. Generally speaking, the air injection system provided on a typical drill rig will be capable of providing air pressure data to the control system 30. If not, such systems could be readily provided by persons having ordinary skill in the art after having become familiar with the teachings provided herein.

Drill rig 16 may also be provided with a water injection system 28 suitable for providing water (or other suitable drilling fluid) to the drill bit 32. Similar to the air injection system 26, pressurized water from the water injection system may be directed through a suitable conduit (not shown) provided in the drill string 20 before ultimately exiting through one or more openings provided in the drill bit 32. Control system 30 is operatively connected to the water injection system 28 and controls the function and operation thereof.

In the embodiment shown and described herein, the control system 30 does not monitor any parameters of the water injection system 28 other than its operational state (e.g., whether the system is "on" or "off"), although provisions could be made to allow the control system 30 to monitor other parameters (e.g., water pressure and flow rate) of the water injection system 28, if desired.

In addition to being connected to the various systems of drill rig 16 so that control system 30 can monitor various drill parameters and control the function and operation of the various systems, control system 30 also stores program steps for program control, processes data, and selects and implements the various hole defect mitigation routines described herein. Accordingly, control system 30 may comprise any of a wide variety of systems and devices suitable for performing these functions, as would become apparent to persons having ordinary skill in the art after having become familiar with the teachings provided herein. Consequently, the present invention should not be regarded as limited to a control system 30 comprising any particular device or system.

By way of example, in one embodiment, control system 30 may comprise a general purpose programmable computer, such as a personal computer, that is programmed to implement the various processes and steps described herein and that can interface with the particular systems provided on drill rig 16. However, because such general purpose programmable computers are well known in the art and could be easily provided by persons having ordinary skill in the art after having become familiar with the teachings provided herein, the particular programmable computer system that may comprise control system 30 will not be described in further detail herein.

Referring now to FIGS. 3-5, the control system 30 may be programmed to implement a method 36 for drilling the boreholes 12. In the first step 38 of method 36, the control system 30 monitors the drill parameters associated with the drill rig 16. Control system 30 may do this via a suitable data interface (not shown) provided between control system 30 and the various sensors or transducers associated with the various systems of drill rig 16. If the various drill parameters monitored by the control system 30 are within the specifications for the various drill parameters, as determined during step 44, the control system 30 will take no further action, other than to continue to operate the various systems of drill rig 16 as required to form the blast hole 14. The control system 30 will continue to monitor the various drill parameters at step 38.

If the control system 30 determines that one or more of the drill parameters being monitored is not in accordance with the specified parameter, then control system 30 will proceed to step 46, wherein the control system 30 chooses or selects a defect mitigation routine.

The particular defect mitigation routine or routines that may be selected by control system 30 will depend on the particular drill parameter that is not within specification, as well as on whether the control system is operating the drill rig 16 in the drilling phase or the retraction phase. If the control system 30 is operating the drill rig 16 in the drilling phase, control system 30 will choose or select from among the various drilling phase defect mitigation routines 40 illustrated in FIG. 4. On the other hand, if the control system 30 is operating the drill rig 16 in the retraction phase, control system 30 will choose or select from among the various retraction phase defect mitigation routines 42 illustrated in FIG. 5.

After the defect mitigation routine has been selected at step 46, control system 30 will then implement the particular defect mitigation routine at step 48. The control system 30 implements the selected defect mitigation routine by operating the various systems of drill rig 16 in the manner described below. After the defect mitigation routine has been implemented, the control system 30 will continue to operate the drill rig 16 at step 50 until the borehole 12 is completed.

The drilling phase defect mitigation routines 40 comprise an air pressure protection routine 52, a rotary stall protection routine 54, an end-of-hole spin-out routine 56, and end-of-hole measurement routine 57, an end-of-hole water control routine 58, and a collaring routine 60. See FIG. 4. In the various embodiments shown and described herein, the collaring routine 60 is performed automatically for every borehole 12. That is, the selection of the collaring routine is not based on whether any particular drill parameter being monitored is outside specification. Accordingly, the collaring routine 60 will be described first, followed by the other drill phase defect mitigation routines 52, 54, 56, 57, and 58.

Figure 6:
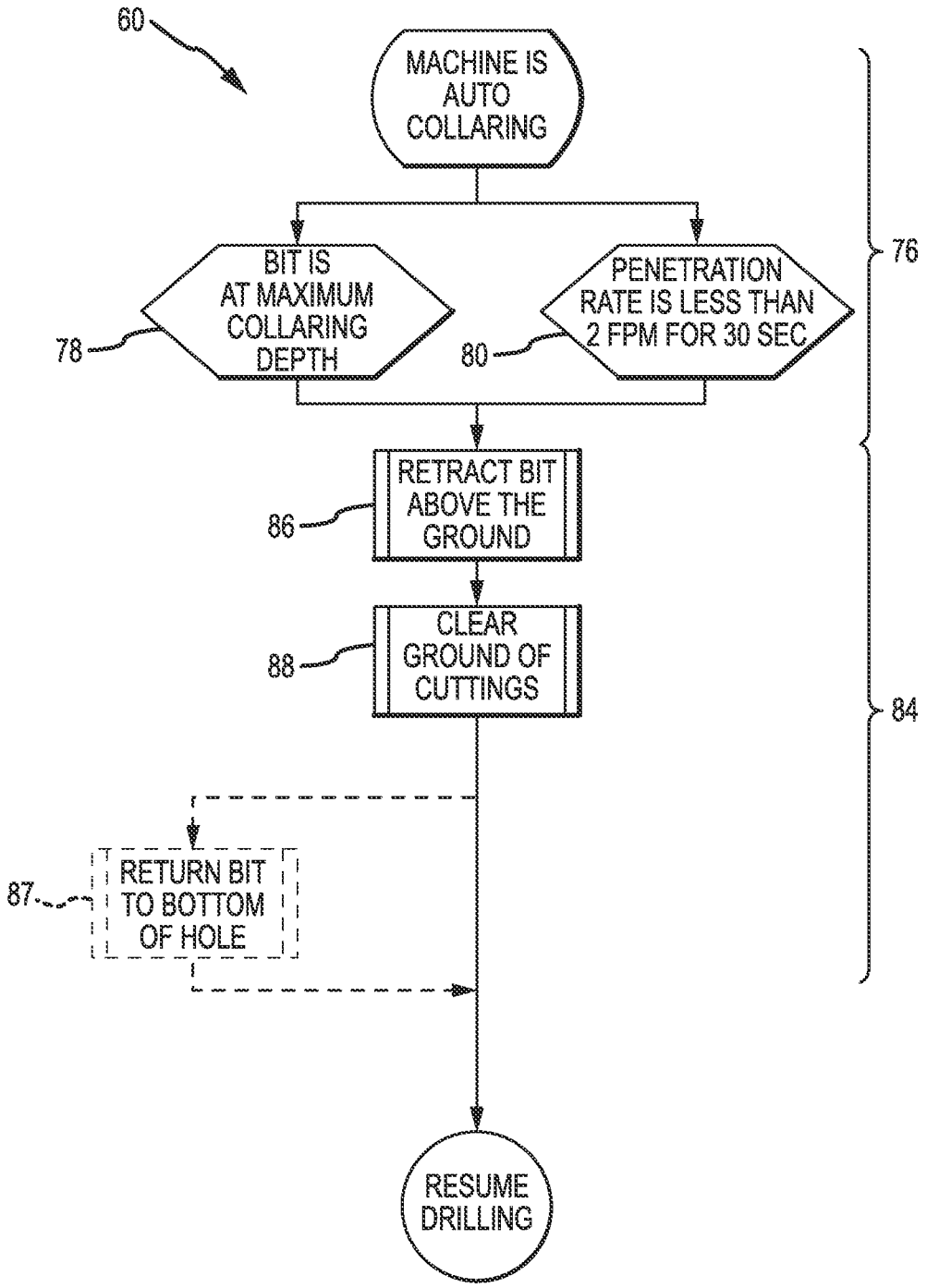
FIG. 6 is a flow chart of a collaring routine.
Figure 7:
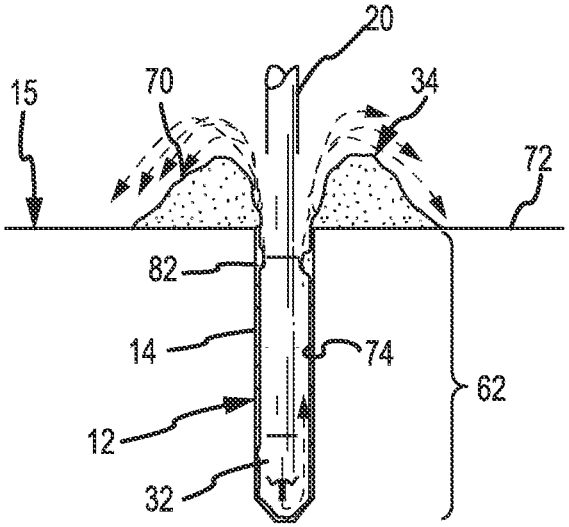
FIG. 7 is a pictorial representation of a borehole during a first phase of the collaring routine.
Figure 8:
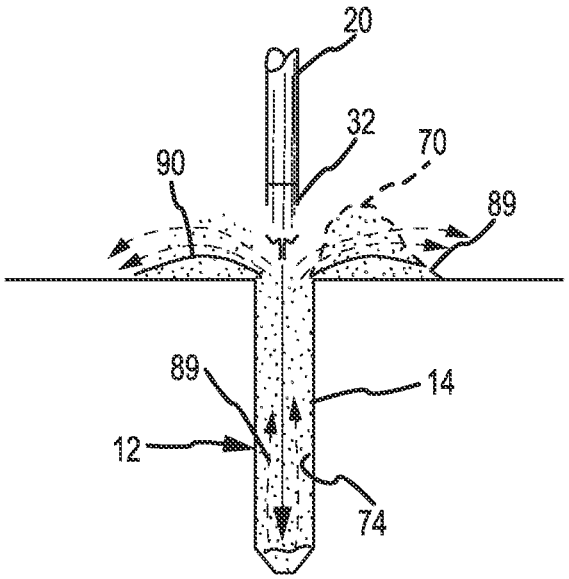
FIG. 8 is a pictorial representation of a borehole during a second phase of the collaring routine.

Referring now to FIGS. 6-8, the collaring routine 60 involves the formation of the collar 62 of the borehole 12. Generally speaking, the collar 62 is regarded as the first 1-3 meters (about 2-10 feet) of the borehole 12. The collaring phase is perhaps the most important phase in blasthole formation. If the hole collar 62 is not properly prepared, both the hole quality and drill rig production will be adversely affected.

A number of factors or conditions can adversely affect the quality of the borehole 12. For example, steep piles 70 of cuttings 34 deposited on the surface 72 adjacent the borehole 12 can result in back-filling of the borehole 12 after completion. Excessive friction between the drill string 20 and the wall 74 of borehole 12 can result in wall failure, crooked boreholes, and poor borehole quality overall. The borehole 12 may also be plugged if the collar 62 is too narrow, particularly near the top of the borehole 12.

The productivity of the drill rig 16 also can be adversely affected if the hole collar 62 is not properly prepared. For example, back-filling or even complete plugging of the borehole 12 means that the drill rig 16 will need to clear the borehole 12 of obstructions, often more than once. Crooked boreholes 12 will typically create excessive friction between the drill string 20 and the borehole wall 74, resulting in the inefficient delivery of power to the drill bit 32. In addition, crooked boreholes 12 and excessive friction can damage the drill rig 16 over time, resulting in increased maintenance costs and poor drill rig performance.

The collaring routine 60 involves a two-phase process to form a high quality hole collar 62. Referring now primarily to FIGS. 6 and 7, the first phase 76 of the collaring routine 60 advances the drill bit 32 to a predetermined depth (i.e., a set depth which represents the maximum collaring depth) at step 78. By way of example, maximum collaring depth may be selected to be in a range of about 1-3 meters (about 2-10 feet), although other depths may be used.

Alternatively, collaring routine 60 may advance the drill bit 32 to a depth that is determined to consist of competent rock, at step 80. Competent rock may be determined if the drill penetration rate falls below a predetermined level for a predetermined period of time. This alternative step 80 may also be referred to herein as "dynamically determined collaring depth," in that the depth of the collar 62 is not fixed, but rather is based on the particular characteristics of the geologic structure 15 in which the borehole 12 is being drilled. As will be described in greater detail below, operating the collaring routine 60 in conjunction with this second option (i.e., step 80) may be advantageous in certain circumstances.

During the first phase 76 of collaring routine 60, cuttings 34 will typically build-up in a steep pile 70 on the surface 72, as best seen in FIG. 7. In addition, it is common for collar plugs 82 to form in borehole 12 at a distance of about half a meter (e.g., about 1 foot) below the surface 72. Both of these conditions are detrimental to hole quality as broken material that would normally lay clear of the borehole 12 has a tendency to fall back into the borehole 12. The second phase 84 of collaring routine 60 may be used to remedy these problems.

Referring now to FIGS. 6 and 8 simultaneously, the second phase 84 of collaring routine 60 involves the retraction of drill bit 32 to location above the ground or surface 72, at step 86. As the drill bit 32 is retracted, the control system 30 activates the water injection system 28. This causes mud to build up on the borehole wall 74, thus stabilizing it. The control system 30 continues to activate the water injection system 28 during the retraction process until the drill bit 32 is above the surface 72. At this point, the control system 30 deactivates the water injection system 28 to terminate the flow of water.

Once the drill bit 32 is retracted to a point above the surface 72, control system 30 activates the air injection system 26 (FIG. 2) to clear the ground of cuttings (i.e., at step 88). High pressure air, represented by arrows 89, exiting holes (not shown) provided in the drill bit 32 will be sufficient to blow the existing and normally steep pile 70 of cuttings 34 created in the first phase 76 away from the opening of borehole 12. Performing step 88 creates a more spread out, shallow cuttings pile 90 that is sufficiently small or spread out to allow future cuttings 34 to pile up in such a way so as to greatly reduce the amount of cuttings 34 apt to fall back into the borehole 12.

Thus, implementation of the two-phase collaring routine 60 results in a far more reliable borehole 12 that is less prone to failure due to back-filling after the drill rig 16 has left the site. In addition, any collar plug 82 (FIG. 7) that may have formed is cleared from the wall 74 of the borehole 12 thereby allowing future cuttings 34 to clear the hole at a high rate of speed, further ensuring that the cuttings 34 will land far enough away from the opening of borehole 12 to prevent hole failure due to backfilling.

In addition to the steps described above, and to ensure a straight hole start, control system 30 may operate the drill hoist 24 to lift the drill bit 32 above the surface 72 by at least about 15 cm (about 6 inches) before rotating the drill bit 32 and starting the borehole 12. This lifting off of the ground and spinning of the drill bit 32 at the beginning of the collaring routine 60 causes any large rocks that may be on or slightly below the surface 72 to be pushed out of the way. By performing this process before starting to drill the borehole 12, the collaring routine 60 ensures that nothing will be in the way of the drill bit 32 that could cause it to be "kicked" sideways, thereby starting the borehole 12 in a crooked manner. If the borehole 12 is not straight when started, it will adversely affect the entire drilling process. In addition, crooked holes may also result in excessive friction between the drill string 20 and the wall 74 of borehole 12, resulting in possible wall failures, short boreholes, and poor hole quality.

As briefly mentioned above with respect to FIG. 6, the first phase 76 of the collaring routine 60 may involve alternative option (e.g., step 80) for determining the depth of the hole collar 62. Step 80 basically allows the depth of the collar 62 to be dynamically determined based on the particular conditions of the geologic structure 15 where the borehole 12 is being drilled, rather than merely drilling to a set depth. Thus, step 80 may be used to ensure that an adequate depth of the borehole 12 is collared (i.e., the collar 62 is of adequate length) without the loss of productivity that would otherwise result from the "over-collaring" of borehole 12. Stated another way, by simply collaring to set depths (i.e., not implementing step 80), drill rig production can be reduced, as the collaring of the boreholes needs to be done more slowly to ensure the quality of the collar 62. However, if the drill bit 32 encounters competent ground early-on, the collaring phase can be shortened. Stated another way, the need to continue the collaring operation is greatly diminished once competent ground is reached. Therefore, once the drill bit 32 contacts competent ground, the control system 30 can complete the collaring routine 60, e.g., by performing the second phase 84, and move on to the drilling phase which typically occurs at a high rate of penetration or drilling.

In one embodiment, the present invention determines competent ground by monitoring the drilling rate, or rate of penetration, over a selected time period. Competent rock or ground is determined if the drill penetration rate falls below a predetermined level for a predetermined period of time. By way of example, in one embodiment, once the rate of penetration drops below about 1 meter per minute (about 2 feet per minute) for a period of about 30 seconds, competent ground is determined to have been reached. The control system 30 will then proceed to the second phase 84 of collaring operation 60 already described.

The second phase 84 of collaring routine 60 may also be provided with an optional step 87 that involves returning the bit 32 to the bottom of hole collar 62 after performing step 88 (i.e., clearing the ground of cuttings). Implementation of optional step 87 may be advantageous in any of a wide variety of circumstances and will help to improve hole quality.

For example, certain geologic conditions may result in a false or erroneous determination of competent rock (e.g., as may be determined during step 80) at the bottom of the hole collar 62. In such cases, the presence of a large rock or other such material located at or near the bottom of the hole collar 62 may result in the deflection of the drill bit 32 upon initiation of the normal drilling sequence, i.e., following the collaring routine 60. Such "down collar" deflection of the drill string 20 may cause the resulting borehole 12 to deviate from its intended path, even though the collar 62 was otherwise properly aligned. In addition, the implementation of optional step 87 will tend to minimize deflection and bowing of the drill string 20 as the drill bit 32 is lowered to the bottom of the collar 62 (i.e., in preparation for the normal drilling sequence). A reduction in bowing and deflection of the drill string 20 will help to ensure that the drill string 20 and drill bit 32 will be properly oriented and aligned within collar 62 when the normal drilling sequence is initiated. Moreover, the reduction or elimination of such bowing and deflection of the drill string 20 will also tend to extend the life of the drill string 20 and preserve the integrity of the drill string pipe joints.

In one embodiment, the optional step 87 (i.e., returning the bit 32 to the bottom of the hole collar 62) involves lowering the drill string 20 into the hole collar 62 at reduced rotary and hoist speeds compared to those that would otherwise be used at the start of the normal drilling operation. During step 87, the system 30 will continue to lower the drill string 20 into the hole collar 62 at the reduced rates until the drill bit 32 has been lowered to the previously determined collaring depth (e.g., as determined by either step 78 or step 80, as the case may be). Once the bit 32 has been lowered to the previously determined collar depth, the control system 30 will then perform step 80 to confirm that competent ground was in fact reached during the formation of the original hole collar 62. In this regard it should be noted that the performance of step 80 as a part of step 87 will be performed for the first time if the collar 62 was originally drilled to a set depth, i.e., by performing step 78. Alternatively, if the depth of the collar 82 was originally dynamically determined, i.e., by performing step 80, then the performance of step 80 as a part of step 87 will be the second time step 80 is performed during the collaring routine 60.

If competent ground is confirmed, step 87 will be complete, and the system 30 will then proceed with the normal drilling operation, i.e., without retracting drill string 20 from the hole collar 62. On the other hand, if competent ground was not reached, e.g., if the original determination of competent ground was in error, the control system 30 will continue to operate drill 20 in accordance with step 80 until competent ground is determined. Thereafter, the normal drilling process will be initiated.

As mentioned above, step 87 involves lowering the drill string 20 into the hole collar 62 at reduced rotary and hoist speeds. These reduced speeds minimize the likelihood that the drill bit 32 or drill string 20 will damage the wall of the hole collar 62 as the drill bit 32 is lowered to the bottom of the hole collar 62. In the particular embodiment shown and described herein, the drill speed is reduced to a value that is in a range of about 30% to about 50% of the normal drill speed for the particular material involved. Alternatively, other reduced drill speeds could also be used. In one embodiment, the reduced hoist speed during optional step 87 is about 3 m/min (about 10 ft/minute), although other reduced hoist speeds could also be used. The pull-down force of the drill hoist system 24 may be selected so that it is substantially identical to the pull-down force applied to drill string 20 during the collaring routine 60, although lower pull-down forces could also be used.

Once the collaring routine 60 is complete, i.e., either with or without the implementation of optional step 87, the control system 30 may initiate normal drilling operations in order to drill the borehole 12 to the desired depth. During the normal drilling operation, control system 30 will continue to monitor the various drilling parameters and implement the various drilling phase defect mitigation routines 40 illustrated in FIG. 4. One of those defect mitigation routines 40 is the air pressure protection routine 52.

Figure 9:
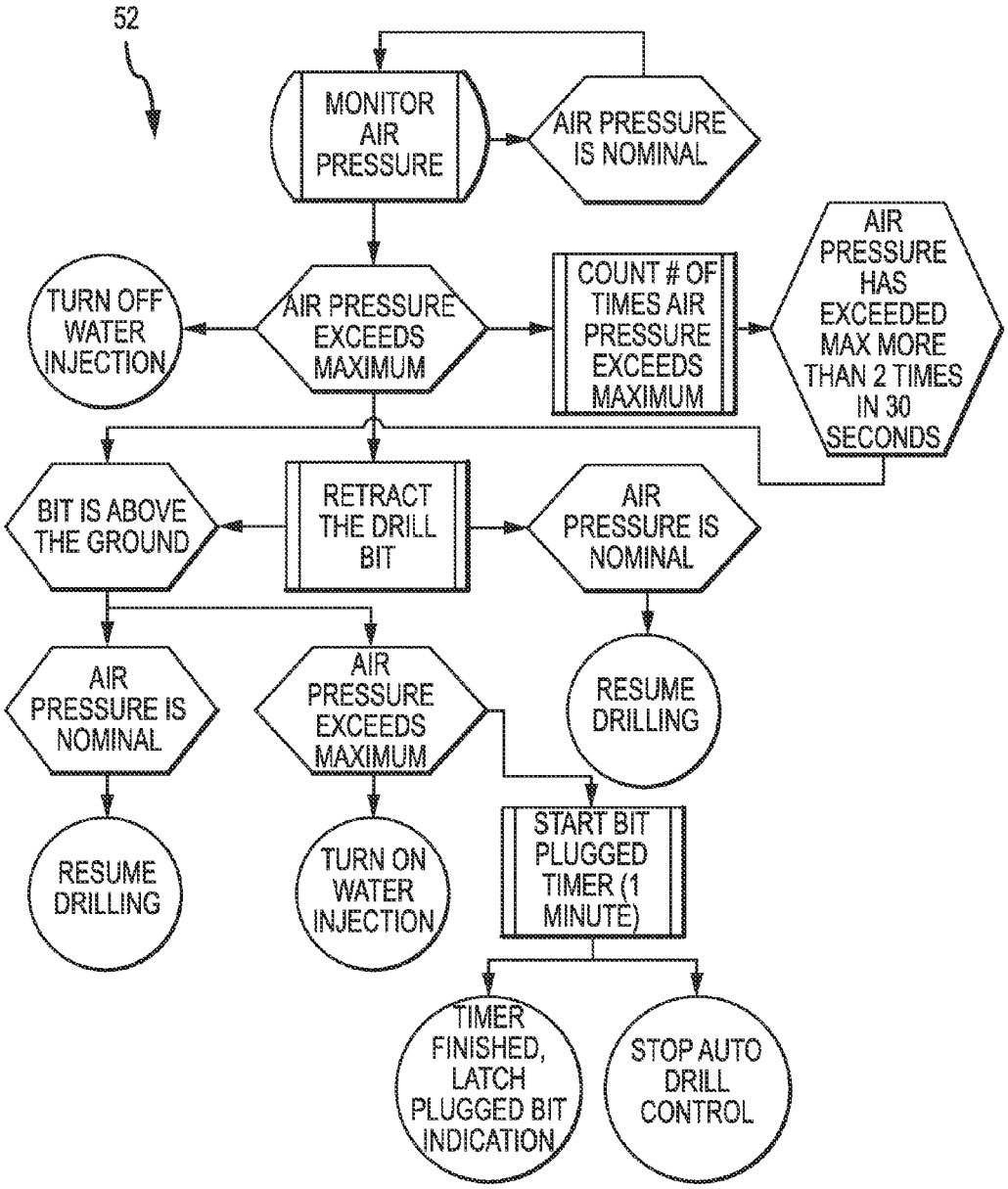
FIG. 9 is a flow chart of an air pressure protection routine.

With reference now primarily to FIG. 9, the air pressure protection routine 52 serves two primary purposes: To provide plugged bit detection and prevention and to provide collapsed hole detection and protection. Both purposes are relevant to hole quality. Plugged bit protection ensures that proper air flow is being provided to the bottom of the borehole 12 to ensure adequate bailing of drill cuttings 34. Without this protective functionality, a plugged drill bit 34 would result in inadequate bailing of drill cuttings 34, causing them to remain in the borehole 12 rather than being bailed out of the borehole 12. In addition, improper bailing velocities can cause erosion of the borehole walls 74, which can lead to wall failure and shallow boreholes 12.

The drill parameter that will cause the control system to select and implement the air pressure protection routine 52 is the air pressure supplied to the drill string 20. If the air pressure is normal, the control system 30 simply continues the normal drilling operation and continues to monitor the air pressure. If the air pressure exceeds the maximum amount, as determined by comparing the monitored air pressure with the predetermined value for air pressure, the control system 30 will follow the various procedures and decision paths set forth in FIG. 9. Basically, the procedures and decision paths involve control of the water injection system 28 as well as the retraction of the drill bit 32 and the resumption of the drilling operation. If the various procedures and decisions paths are unable to clear the plugged drill bit 32, the system will provide a plugged bit indication to the system operator and will stop the drilling process.

Figure 10:
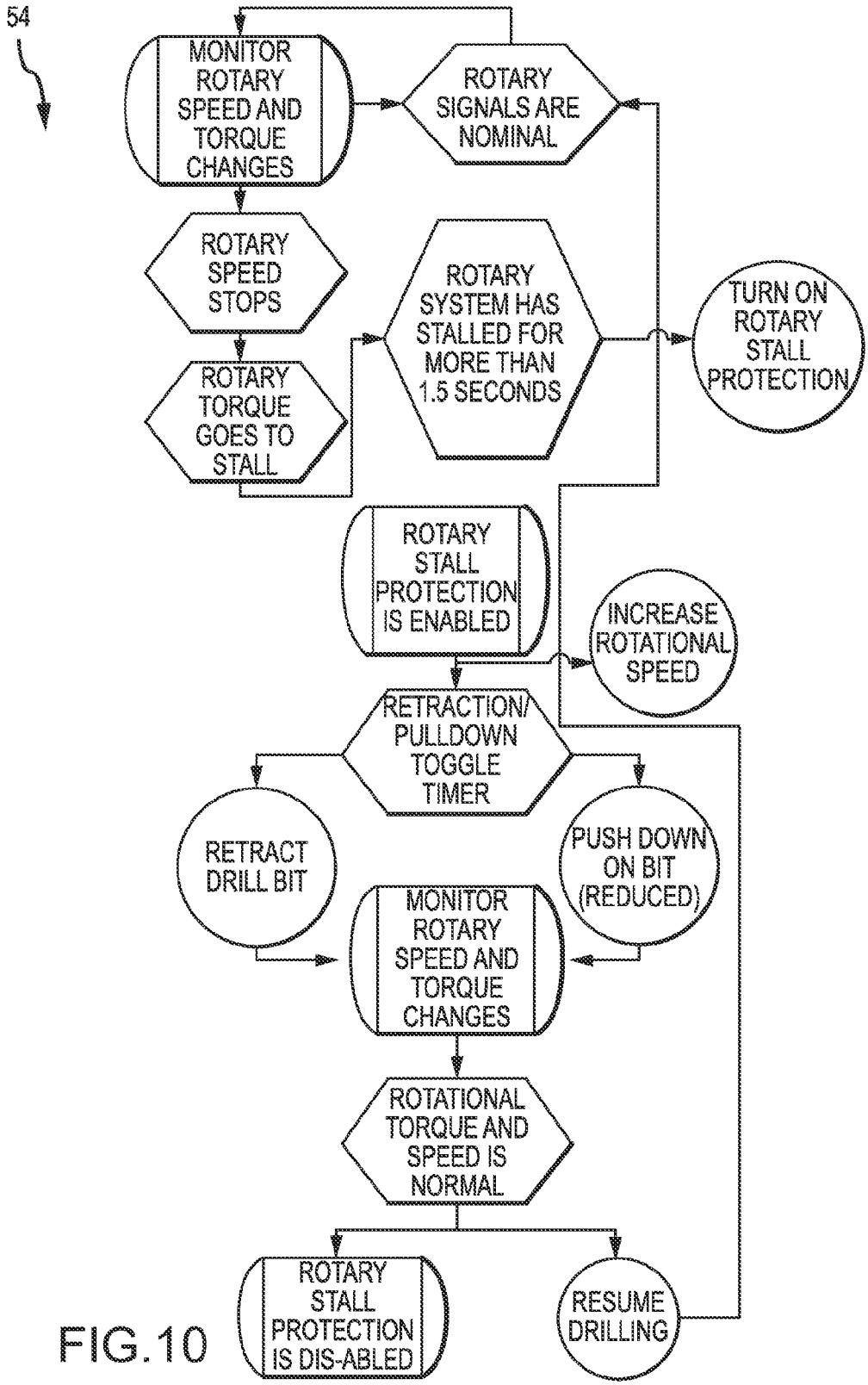
FIG. 10 is a flow chart of a rotary stall protection routine.
Figure 11:
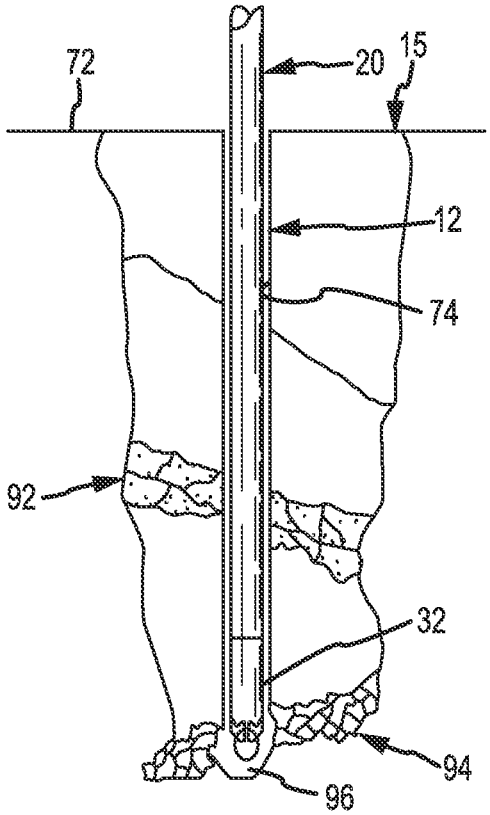
FIG. 11 is a pictorial representation of a borehole showing moderate and heavy fracture zones.

Referring now to FIGS. 10 and 11, the rotary stall protection routine 54 detects and mitigates problems likely to arise from various sub-surface fractures 92 that may be contained in the geologic structure 15 that are being penetrated by drill string 20. Sub-surface fracturing of the rock or geologic structure 15 tends to be very detrimental to borehole quality in that, as the drill bit 32 penetrates the fractured area 92, the drilling process causes the fractured area 92 to further break apart or loosen at the wall 74 of the borehole 12. The loosened or broken material has the potential for falling into the borehole 12 after the drill rig 16 has left the borehole 12 upon completion of the drilling process. This situation must be mitigated in order to ensure quality boreholes 12 that will stand up over a period of time.

The rotary stall protection routine 54 detects these fractured areas 92 due to the probability of bit stalling when penetrating the fracture areas 92. More specifically, as the broken or fractured area 92 is penetrated by drill bit 32, the loose rock breaks apart in large pieces that often become wedged between the drill string 20 and borehole wall 74. This wedging of broken material causes the drill string to stop rotating and thereby "stalls" the drill motor system 22. The control system 30 detects this stalled condition by monitoring the torque applied to drill bit 32 as well as its rotational speed. If the torque suddenly increases or spikes and the rotational speed suddenly drops, then control system 30 determines that the drill motor system 22 is stalling, as best seen in FIG. 10.

In addition, and with reference now primarily to FIG. 11, when fractured areas 92 are encountered, they can cause failure points in the wall 74 of the borehole 12. These failure points are manifested as voids in the normally intact borehole wall 74. Loose rocks and material may fall to the bottom of the borehole 12 resulting in boreholes 12 that are not as deep as when originally drilled. In catastrophic cases, i.e., where the geologic structure 15 is heavily fractured, these voids can lead to complete hole failure, i.e., where the entire borehole 12 is filled up by sloughing material from the fractured areas 92. For example, and as illustrated in FIG. 11, a heavily fractured area 94 near the bottom of the borehole 12 has resulted in a major void 96 forming at the bit 32. Failing to reduce the penetration rate and rotational speed will result in a hole failure in most instances.

Referring back now to FIG. 10, if control system 30 determines that the stalled condition has persisted for longer than some predetermined time, 1.5 seconds, for example, then the control system 30 will implement the rotary stall protection routine 54. More specifically, control system 30 will operate drill hoist system 24 to retract the drill bit 32 to re-enable the rotation of drill bit 32. If the rotational speed of the drill bit 32 does not recover within some period of time, for example within 3 seconds, the control system 30 will operate drill hoist system 24 to alternately apply pull-down and pull-up forces to the drill string 20 in an attempt to free drill bit 32 and allow it to rotate again. Once bit rotation has been re-established, the control system 30 will operate the hoist system 24 to slowly lower the bit 32 back to the bottom of the borehole 12. Thereafter, control system 30 will reduce the pull-down force to avoid further stalling of the drill bit 32. In addition, the control system 30 will increase the rotational speed of drill bit 32 to further assist in the grinding up of the broken particles from the fractured areas 92.

In one embodiment, the reduction of pull-down force and increase in rotational speed is maintained until the drill rig 16 meets the following conditions (i.e., indicating that the drill bit 32 has passed the fractured area 92): There are no torque spikes for at least 15 seconds; and the rate of penetration has stopped changing (e.g., the penetration rate change over a time period of about 1 second is less than about 6 cm per minute (about 0.2 feet per minute)). Alternatively, other values for these parameters could be used. Once these conditions are met, the control system 30 increases the pull-down force to normal values. Control system 30 continues to monitor the drill parameters to ensure that the bit 32 is not going to stall again. In summary, then, by slowly penetrating the fractured areas 92, further damage to the wall 74 of borehole 12 is avoided and a quality borehole 12 is further insured.

Figure 12:
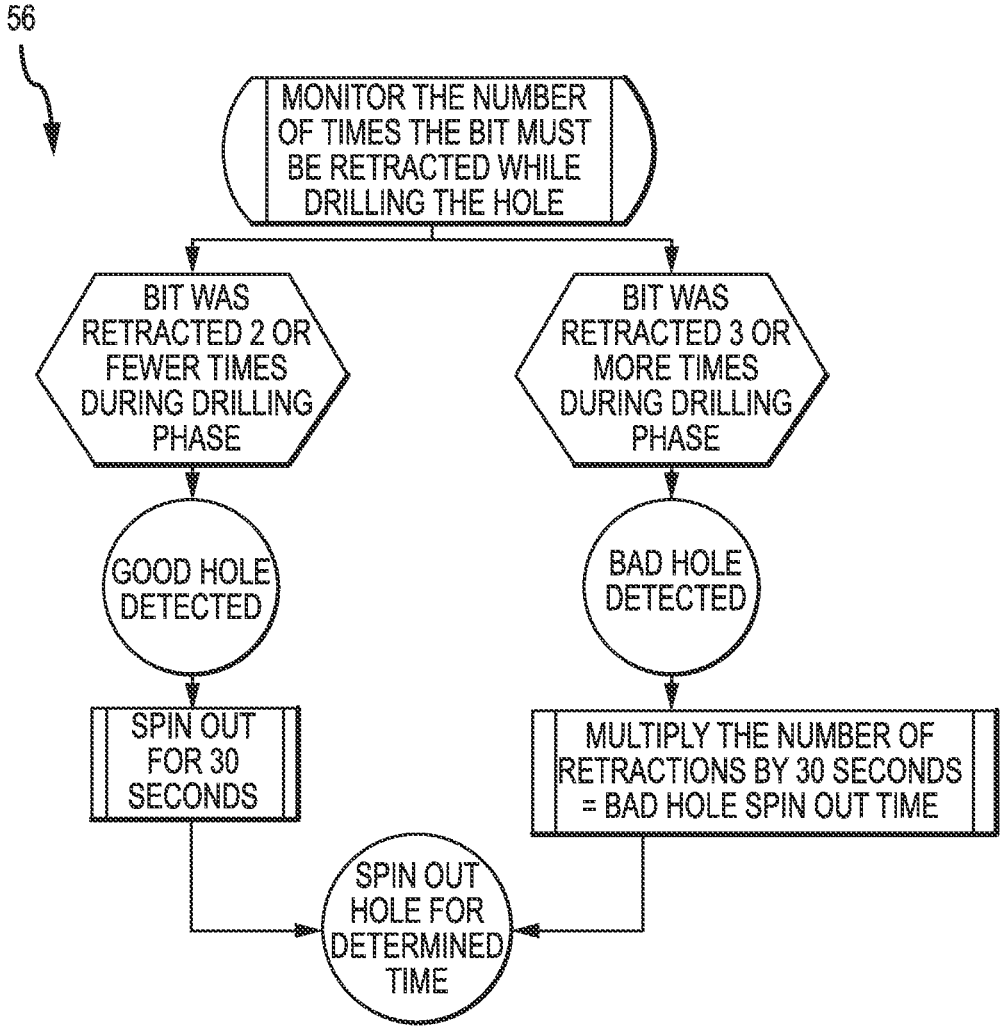
FIG. 12 is a flow chart of an end-of-hole spin-out routine.

The end-of-hole spin-out routine 56 is illustrated in FIG. 12. Once the drill bit 32 reaches the predetermined or prescribed depth, the control system 30 will spin the drill bit 32 just above the bottom of the hole and allow all the cuttings 34 that have been created to be bailed from or exit the borehole 12. Significantly, the time required at the bottom of the borehole 12 is variable and is determined by how much trouble the system 10 has encountered during the drilling phase. Basically, the monitored drill parameters will allow the control system to determine whether the particular borehole 12 is a "good" or a "bad" borehole, more precisely, whether the geologic structure 15 is stable or unstable. A good borehole is defined as a borehole 12 that required the control system 30 to retract the drill bit 32 less than two (2) times during the drilling phase. If the control system 30 determines the borehole 12 to be good, then the end of the hole spin-out time will be 30 seconds, which will be sufficient in most instances to allow all cuttings 34 to be bailed from the borehole 12.

On the other hand, if control system 30 determines the borehole 12 to be bad, then control system calculates the spin-out time by multiplying by 30 seconds the number of times the bit 32 had to retracted. For example, if the bit 32 had to be retracted two times, then the spin-out time is determined or calculated to be sixty (60) seconds. Similarly, if the bit 32 had to be retracted three times, then the spin-out time is calculated to be ninety (90) seconds. In the embodiment shown and described herein, the maximum spin-out time is limited to two (2) minutes. Alternatively, of course, other maximum time limits could be set, as would become apparent to persons having ordinary skill in the art after having become familiar with the teachings provided herein.

In the embodiment shown and described herein, the end-of-hole spin-out routine 56 also may be selected and implemented during the retraction phase of the drilling process. That is, if control system 30 detects a problem while retracting the bit, control system 30 will re-set the hole spin-out time. Control system 30 will then re-lower drill bit 32 to the bottom of the borehole 12 and perform again the end-of-hole spin-out routine 56. If multiple passes are required to penetrate the hole, the end-of-hole spin-out time is accumulated accordingly.

Figure 13:
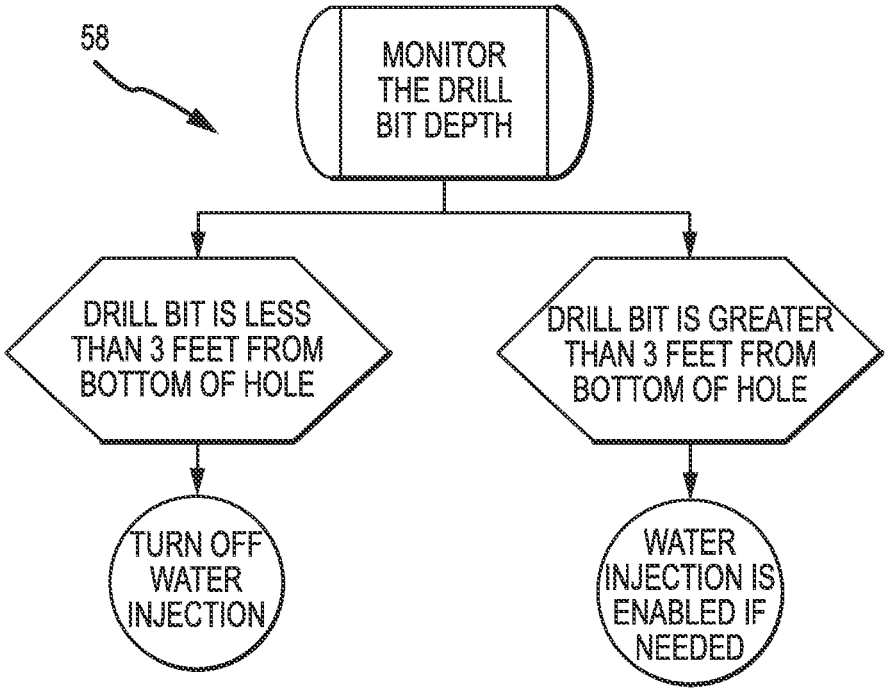
FIG. 13 is a flow chart of an end-of-hole water control routine.

The end-of-hole water control routine 58 is illustrated in FIG. 13. As the drill bit 32 approaches the predetermined or prescribed hole depth, the control system 30 disables the water injection system 28 to allow dry cuttings 34 to attach to the wet walls 74 of the borehole 12. In one embodiment, the control system 30 disables the water injection system 28 (i.e., turns off the flow of water) when the drill bit 32 is about 1 meter (about 3 feet) from the bottom of borehole 12. Alternatively, other distances could be used, as would become apparent to persons having ordinary skill in the art after having become familiar with the teachings provided herein.

Implementing the end-of-hole water control routine 58 causes a coating to be formed on the borehole wall 74 that helps to stabilize the borehole wall 74. This coating significantly reduces the likelihood that loose rock will fall from the borehole wall 74, further reducing the possibility of hole failure. Put another way, implementation of the end-of-hole water control routine 58 further mitigates any sub surface fractures that might transverse the borehole 12.

After the borehole 12 has been completed, i.e., at the conclusion of the drilling phase, the control system 30 may proceed directly to the retraction phase, as will be described below. Alternatively, however, the control system 30 may optionally perform an end-of-hole measurement routine 57 (FIG. 4) before entering the retraction phase. The control system 30 may choose or implement end-of-hole measurement routine 57 when the monitored drill depth meets a predetermined specification for drill depth (i.e., the prescribed depth). In addition, the end-of-hole measurement routine 57 may be performed at some point during the retraction phase, as will also be described in greater detail below.

The end-of-hole measurement routine 57 may be used to determine the "as-drilled" depth of the borehole 12. Ideally, step 57 will confirm that the borehole 12 was, in fact, drilled to the prescribed depth. However, there may be circumstances where the as-drilled depth of the borehole 12 will vary from the prescribed depth. If so, step 57 will detect this variance. The control system 30 may then resume the drilling process until the borehole 12 reaches the prescribed depth, as determined by monitoring the drill depth parameter. Step 57 can then be repeated until it is confirmed that the borehole 12 has been successfully drilled to the prescribed depth.

Figure 14:
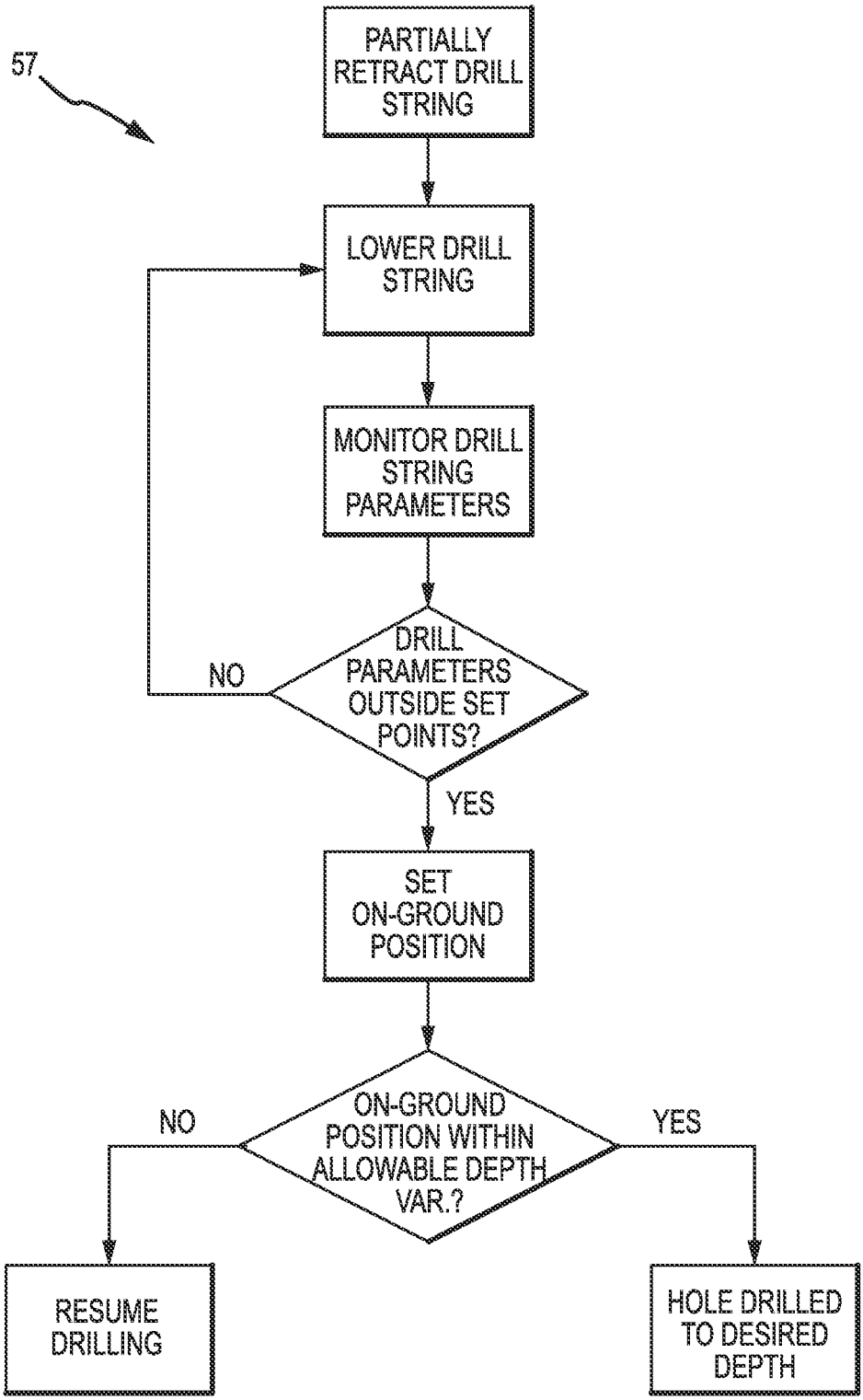
FIG. 14 is a flow chart of an end-of-hole measurement routine.

Referring now primarily to FIG. 14, the end-of-hole measurement routine 57 involves a partial retraction of the drill string 20 from the borehole 12. This partial retraction allows any loose or unstable material that would otherwise fall to the bottom of the borehole 12 (e.g., during the retraction phase) to fall to the bottom early, thereby allowing for a more accurate determination of borehole depth than would otherwise be the case if the system simply monitored the drill depth parameter during the drilling phase.

Next, the drill string 20 is lowered (i.e., re-lowered) in borehole 12. During the lowering process, the control system 30 monitors various drill parameters and compares them with corresponding set points. If the drill parameters fall outside the corresponding set points for a predetermined period of time, the control system will determine that the drill bit 32 has reached an "on ground position." The "on ground position" is that position deemed to correspond to the bottom of the borehole 12. For example, if the borehole 12 was free of cave-ins (i.e., if no material fell to the bottom of the borehole 12 while the drill string was in the partially retracted position), then the "on ground position" will be substantially equal to the prescribed borehole depth. On the other hand, if some cave-in or wall failure occurred while the drill string 20 was in the partially retracted position, then the "on ground position" will differ from the prescribed borehole depth. If the "on ground position" differs from the prescribed borehole depth by more than an allowable depth variation, then the system 30 will resume the drilling process. Step 57 may be repeated until the "on ground position" of the borehole is within the allowable depth variation.

In one embodiment, the drilling parameters measured during the process 57 are the hoist speed, the pull-down force, and the drill torque. If all of these values fall outside the corresponding set points for the predetermined period of time, then the location at which this occurred is determined to be the "on ground position." Alternatively, in another embodiment, the "on ground position" determination may be made at that location where at least one of the drilling parameters fell outside the corresponding set point for the predetermined period of time.

The retraction distance, predetermined period time, the set points for the various drill parameters, and the allowable depth variation used in process 57 may be selected during commissioning of the drilling system 10. Consequently, the values may vary depending on a wide variety of factors, as would become apparent to persons having ordinary skill in the art after having become familiar with the teachings provided herein. Consequently, the present invention should not be regarded as limited to any particular values for these parameters. However, by way of example, in one embodiment, the drill string retraction distance is selected to be about 25% of the prescribed borehole depth. Generally speaking, such a retraction distance will be sufficient to allow loose or unstable material to fall to the bottom of the borehole 12. Alternatively, however, other retraction distances may be used, depending on the particular soil conditions or on other factors.

In this regard it should be noted that the retraction distance need not comprise some percentage of prescribed borehole depth, but could instead comprise some fixed distance, such as 3 meters (about 10 feet). However, retraction of the drill string 20 by some fixed distance, rather than by a percentage of the prescribed borehole depth may be less than desirable in certain circumstances. For example, if the prescribed borehole depth is only about 7.6 m (about 25 feet), then a partial retraction of the drill string 20 by the fixed distance of 3 m (about 10 feet), would be nearly 50% of the prescribed borehole depth, a greater retraction than is typically necessary. Conversely, if the prescribed borehole depth is about 15.2 m (about 50 feet), then a partial retraction of 3 m (about 10 feet), may not be sufficient to allow any loose or unstable material to fall to the bottom of the borehole.

The set points for the various drill parameters also may be determined during commissioning of the drill system 10, thus may vary to some degree depending on the particular application and soil conditions. Consequently, the present invention should not be regarded as limited to any particular set points for the various parameters. However, by way of example, in one embodiment, the set point for hoist speed is selected to be about 6 m/min (about 20 ft/min), whereas the set point for pull-down force is selected to be about 89 kN (about 20,000 lbs). The rotational torque set point is selected to be about 40% of maximum torque. The predetermined time period may be selected to be one (1) second, although other time periods could also be used. The hole depth variation may be selected to be about 0.6 m (about 2 feet), although other values may be used, again depending on any of a wide variety of factors.

Accordingly, in the particular embodiment shown and described herein, if the hoist speed drops below about 6 m/minute (about 20 feet/min) and the pull-down and torque forces exceed about 89 kN (about 20,000 lbs) and 40%, all for a time period greater than 1 second, then the system 30 determines that the drill bit 32 is "on ground position". The system 30 then compares the "on ground position" depth with the prescribed borehole depth. If the difference exceeds 0.6 m (about 2 feet), then the system 30 will resume the drilling operation. If, on the other hand, the "on ground position" is within 0.6 m (about 2 feet) of the prescribed borehole depth, then the borehole 12 is deemed to have been drilled to the desired depth. The control system 30 may then proceed to the retraction phase.

As was already briefly mentioned above, the retraction phase is that phase of the drilling process during which the drill bit 32 is retracted from the bottom of the borehole 12 after reaching the desired depth. The retraction phase is complete when the drill bit 32 is fully retracted from borehole 12 and the drill rig 16 ready to move to the next hole location. As illustrated in FIG. 5, the retraction phase defect mitigation routines 42 include a drill bit hang-up protection routine 64, a torque monitoring routine 66, and a hole clean-out routine 68. The control system 30 chooses and implements one or more of the various retraction phase defect mitigation routines 42 based on one or more monitored drill parameters of drill rotational speed, drill torque, hoist speed, and the number of drill retractions that were performed during the drilling phase.

Figure 15:
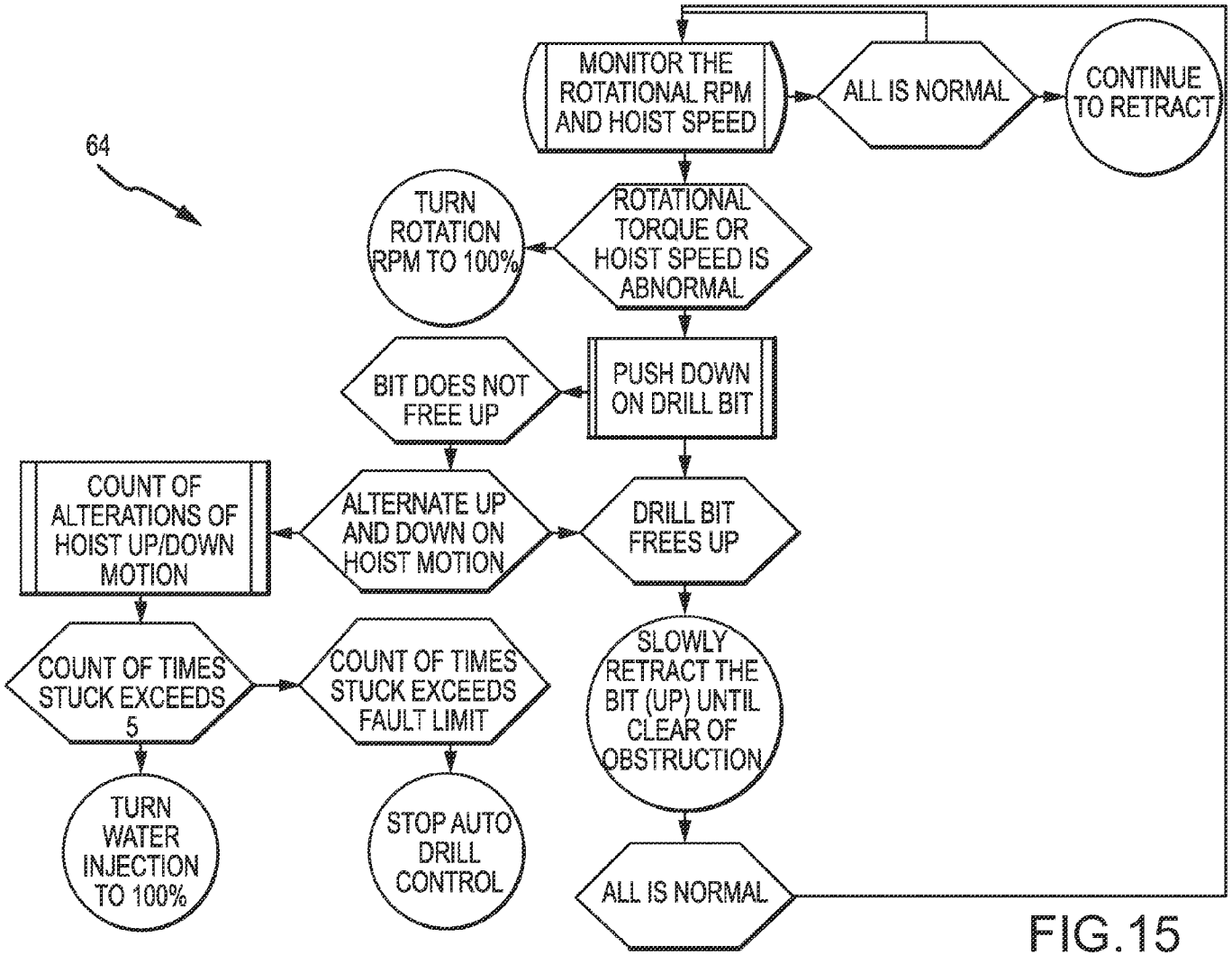
FIG. 15 is a flow chart of a drill bit hang-up protection routine.
Figure 16:
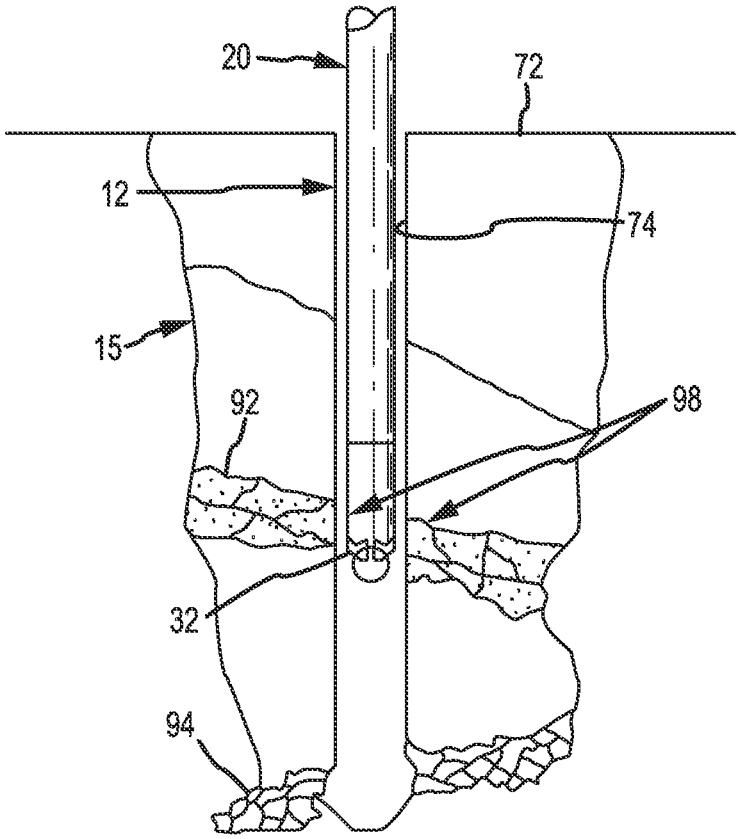
FIG. 16 is a pictorial representation of a borehole showing a blockage area around the drill.

Referring now to FIG. 15, when retracting the rotation drill string 20 from the borehole 12, control system 30 monitors the hoist speed (i.e., the speed at which the drill bit 32 is being retracted from borehole 12). Control system 30 also monitors the torque applied to the drill bit 32 as well as its rotation speed. Control system 30 compares these monitored drill parameters with predetermined specifications for these respective parameters during the retraction phase. If the bit retraction rate and rotational speed decline with a corresponding increase in torque, it is likely that material 98 has fallen from borehole wall 74 and is interfering with the rotating drill bit 32, as illustrated in FIG. 16. Once the drill bit 32 has been jammed or hung-up by material 98, control system 32 implements or performs the various steps illustrated in FIG. 15 to mitigate the condition.

Upon concluding that the drill bit 32 has been hung-up or jammed by material 98, the control system 30 first tries to free the drill bit 32 from the obstruction (i.e., material 98) encountered during retraction. More specifically, the control system 30 operates the drill motor system 22 (FIG. 2) to apply maximum torque to the drill bit 32 in an attempt to cause the drill bit 32 to free itself from material 98. Control system 30 also operates the drill hoist system 24 to reverse the hoist force applied to the drill string 20. That is, control system 30 will stop applying a pull-up force to the drill string 20 and will instead apply a pull-down force to the drill string 20. In one embodiment, control system 30 applies the pull-down force for a period of 3-5 seconds in an attempt to cause the drill bit 32 to be freed from the blockage.

If the drill bit 32 does not begin to move either up and down or to rotate freely, then control system 30 operates the drill hoist system 24 to alternately apply pull-up and pull-down forces to drill string 20. In one embodiment, the pull-up and pull-down forces may each be applied for a time period or cycle ranging from about 3 seconds to about 5 seconds, although other cycle times may also be used.

If the drill bit 32 is not free after some number of pull-up/pull-down cycles, then control system 30 activates the water injection system 28 in an attempt to use water to free the obstruction. The number of pull-up/pull-down cycles and the amount of water applied may vary depending on the particular application, as would become apparent to persons having ordinary skill in the art after having become familiar with the teachings provided herein. Consequently, the present invention should not be regarded as limited to any particular number of pull-up/pull-down cycles or any particular water flow. However, by way of example, in one embodiment, control system 30 activates the water injection system 28 to provide 100% water flow if the drill bit 32 has not been freed after 5 pull-up/pull-down cycles.

If drill bit 32 remains jammed even after water injection and if drill bit 32 remains jammed after exceeding some predetermined fault limit, control system 30 will terminate the retraction process. Control system 30 may then alert a system operator that it was not successful in freeing the drill bit 32.

If the drill bit 32 begins to rotate, indicating that it is freed from the blockage, then control system 30 operates drill hoist system 23 to hoist up the bit 32 at a greatly reduced rate of speed. Control system 30 also operates drill motor system 22 to increase the bit rotation speed to maximum. This is done in an attempt to slowly bring the drill bit 32 above the blockage that exists. This slow retraction, combined with the high bit rotation speed allows the drill bit 32 to gradually break up the material 98 that has caused the blockage in borehole 12. By way of example, in one embodiment, the reduced rate of speed is about 0.3 m per minute (about 1 foot per minute). The rotation rate is about 90 revolutions per minute (rpm), which is about 90% of maximum rpm in this example. Alternatively, other reduced hoisting speeds and bit rotation rates may be used as well.

After the drill bit 32 has cleared the obstruction, control system 30 may return to a normal retraction speed until the bit 32 has cleared the borehole 12. Thereafter, control system 30 may implement the hole clean-out routine 68.

Other issues or problems may occur during the retraction phase that are not so severe as to cause the drill bit 32 to become jammed (thus requiring implementation of the drill bit hang-up protection routine 64), but that may nevertheless adversely affect hole quality.

Figure 17:
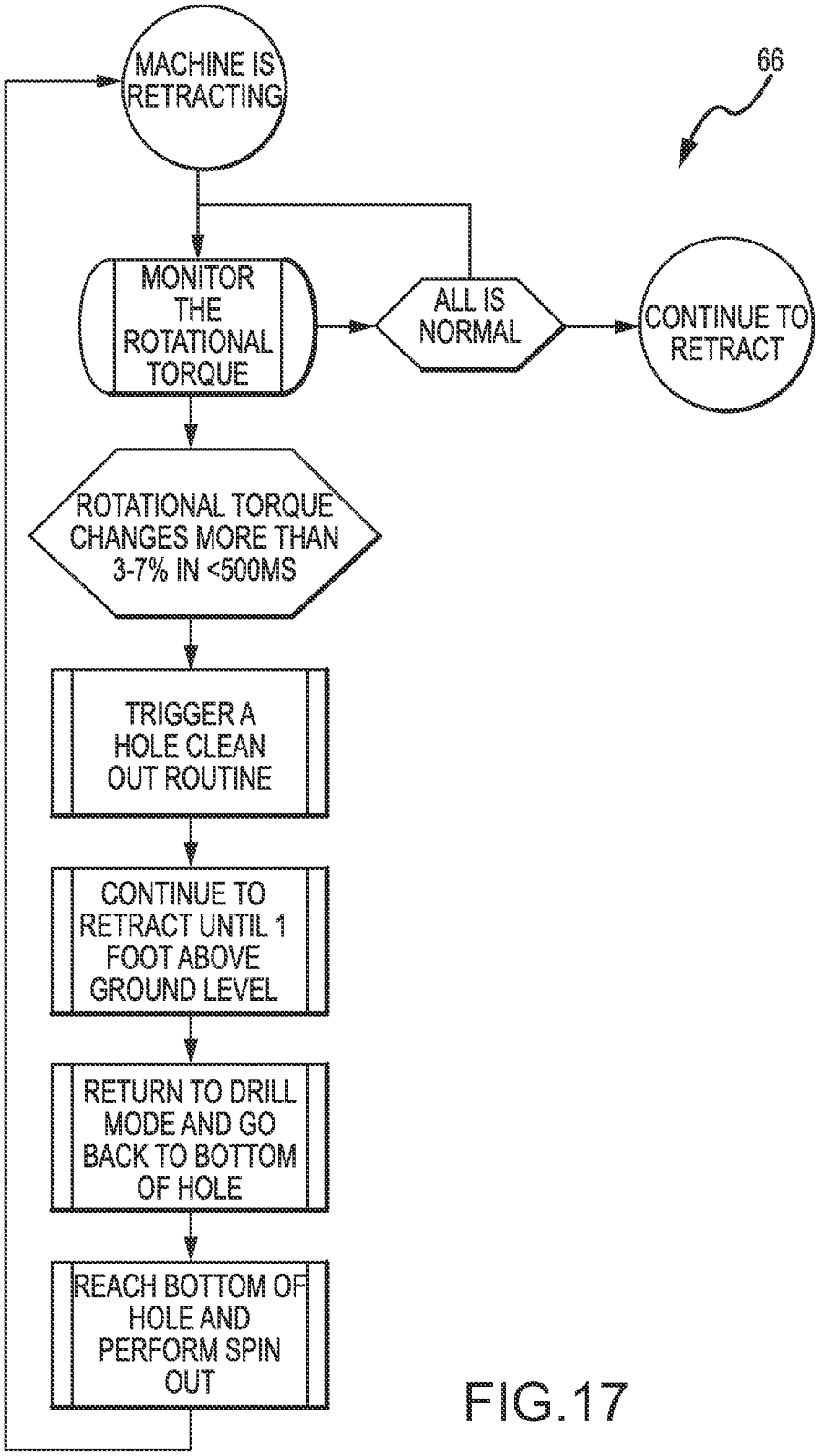
FIG. 17 is a flow chart of a torque monitoring routine.

For example, and referring now primarily to FIG. 17, control system 30 implements torque monitoring routine 66 during the retraction phase. During this routine 66, control system 30 monitors the torque applied by the drill motor system 22 as the drill bit 32 is being retracted from borehole 12. If the torque varies by more than a predetermined amount within a predetermined time, then control system 30 will implement clean-out routine 68 (FIG. 5). The variation in rotational torque indicates that the drill bit 32 has contacted something that is sticking out from the drill wall 34 sufficiently far to cause interference with the drill bit 32. Once contact is made sufficient to cause a variation in torque, it is assumed that the drill bit 32 has dislodged the obstruction and caused it, and possibly additional material, to fall to the bottom of the blast hole resulting in a shortened hole and thereby poor hole quality.

It should be noted that even small variations in torque may be indicative of problems that could adversely affect hole quality. For example, in one embodiment, torque variations as low as about 3 percent to about 7 percent that occur within about 500 milliseconds or less are indicative of problems that are likely to adversely affect hole quality.

The rotational torque monitoring routine 66 will continue to trigger hole clean out routines 68 until no torque variations occur during the retraction phase. Alternatively, control system 30 may terminate the retraction phase if more than a predetermined number of attempts have been made that would indicate that the borehole 12 is not possible to drill.

The hole clean-out routine 68 performs a "re-drill" of the borehole 12 from start to finish. In one embodiment, the control system 30 implements the hole clean-out routine 68 under the following conditions:

- The drill bit 32 needed to be retracted more than twice during the drilling phase as a result of the implementation of the air pressure protection routine 52 or the rotary stall protection routine 54;
- The implementation of the drill bit hang protection routine 64; or
- A rotational spike occurred (e.g., during the implementation of the torque monitoring routine 66).

The hole clean-out routine 68 incorporates all processes, including the monitoring and implementation of the various hole defect mitigation routines 40, used during the normal drilling phase. If any of the above conditions are triggered again during the re-drilling of the hole, the entire clean out process will be re-started after the current clean out process is completed. This will continue for some predetermined number of clean out attempts. Thereafter, the control system 30 will stop trying to clean the hole and will mark the borehole 12 as a possibly bad hole that will need to be checked, if desired. In one embodiment, the predetermined number of clean-out attempts is selected to be seven (7) and is user-adjustable. That is, the number may be varied by a user depending on a number of factors, such as, for example, the importance of forming a substantially defect-free borehole compared to the number of holes desired to be drilled within a given time frame.

As mentioned above, the end-of-hole measurement routine 57 may be implemented at any point in the retraction phase, if desired. For example, if the hole was determined to be "bad" during the retraction phase, e.g., during the performance of the hole clean-out routine 68, then the control system 30 may elect to again perform the end-of-hole measurement routine 57 to confirm that the borehole 12 remains at the prescribed depth. The performance of the end-of-hole measurement routine 57 at the conclusion of the hole clean-out routine 68 may be substantially identical to the performance of routine 57 at the conclusion of the drilling phase already described above.

The system 10 may be operated as follows to cause the drill rig 16 to drill a borehole 12, such as a blasthole 14, in a geologic structure 15 (i.e., the ground). In the embodiment shown and described herein, the system 10 may be operated in a fully automatic mode wherein the system 10 automatically positions the drill rig 16 over the selected hole location and proceeds to automatically drill the borehole 12 in accordance with the teachings provided herein.

Once the drill rig 16 has been properly positioned, i.e., so that borehole 12 will be drilled at the desired location, the control system 30 may initiate the drilling phase of operation. During the drilling phase, the control system 30 operates the drill motor 22, drill hoist 24, air injection system 26, and water injection system 28 to begin rotating and advancing the drill bit 32 into the ground or geologic formation 15. During the drilling phase, the control system 30 monitors (i.e., at step 38) the various drill parameters that are generated or produced by the various systems comprising drill rig 16.

During the drilling phase, the drill parameters monitored by control system 30 include air pressure, drill rotational speed, drill torque, drill depth, and the number of times the drill has been retracted during the drilling phase. The control system 30 compares these various drill parameters with predetermined specifications for the respective parameters. If one or more of the drill parameters is outside of the predetermined specification, the control system 30 chooses and implements one or more drilling phase defect mitigation routines 40, as best seen in FIG. 4.

As mentioned, in one embodiment, the control system 30 will automatically implement the collaring routine 60 at the start of each borehole 12. That is, in one embodiment, the selection and implementation of the collaring routine 60 is not dependent on whether any drill parameter is within the predetermined specification. The collaring routine 60 creates a high quality collar 62. Thus, automatically implementing the collaring routine 60 on every borehole 12 helps to ensure that each hole collar 62 will be of a high quality.

Of course, if none of the monitored drill parameters are outside the predetermined specification for each parameter, then control system 30 will simply drill each borehole 12 in accordance with a developed drilling phase methods. That is, control system 30 may well drill a number of holes wherein none of the various drilling phase defect mitigation routines (with the exception of the collaring routine 60) will need to be implemented. On the other hand, and depending on which drill parameters are outside of specification, control system 30 may choose and implement one, several, or all of the drilling phase mitigation routines 40 on a single borehole 12.

After the borehole 12 has been drilled to the desired or target depth, the control system 30 will then operate the drill rig 16 in the retraction phase, i.e., withdraw the drill string 20 from the borehole 12. Control system 30 monitors various drill parameters during the retraction phase. Again, if none of the various parameters exceed or are outside the predetermined specifications for those parameters, then the drill string 20 is simply withdrawn from the borehole 12. The drill rig 16 may then be moved or trammed to the location for the next borehole. On the other hand, if one or more of the drill parameters being monitored during the retraction phase exceed or are otherwise outside the corresponding predetermined specification, then control system 30 may implement one or more of the retraction phase defect mitigation routines 42 in the manner described herein.

Having herein set forth preferred embodiments of the present invention, it is anticipated that suitable modifications can be made thereto which will nonetheless remain within the scope of the invention. The invention shall therefore only be construed in accordance with the following claims:

What is claimed is:

1. A system for drilling a borehole, comprising:

a drill rig comprising a drill including a drill bit, an air injection system, and a water injection system; and a control system operatively associated with said drill rig, said control system:

monitoring drill parameters comprising drill rotational speed, drill torque, drill depth, hoist speed and number of drill retractions;

receiving information from said drill rig relating to at least one drill parameter, controlling each of said drill, said air injection system and said water injection system, storing program steps for program control, and processing data; and said control system processing information relating to the drill parameter, determining whether the drill parameter is within a predetermined specification for at least one monitored drill parameter for a drilling phase or a retraction phase, the retraction phase following completion of the drilling phase, choosing a hole defect mitigation routine based on the at least one monitored drill parameter when the at least one drill parameter is outside the predetermined specification, said hole defect mitigation routine comprising at least one drilling phase defect mitigation routine for implementation during the drilling phase, said drilling phase defect mitigation routine comprising at least one selected from the group consisting of rotary stall protection, end-of-hole spin-out, and end-of-hole water control, and at least one retraction phase mitigation routine for implementation during the retraction phase, said control system controlling said drill rig to implement said rotary stall protection routine when for a predetermined period of time one or both of said monitored drill rotational speed is outside a predetermined specification for rotational speed and said drill torque is outside a predetermined specification for drill torque, said rotary stall protection routine comprising:

retracting the drill bit;

rotating the drill bit; and resuming the drilling phase with of at least a reduced down-force until drill penetration rate stops changing.

2. A system for drilling a borehole, comprising:

a drill rig comprising a drill including a drill bit, an air injection system, and a water injection system; and a control system operatively associated with said drill rig, said control system:

monitoring drill parameters comprising drill rotational speed, drill torque, drill depth, hoist speed and number of drill retractions;

receiving information from said drill rig relating to at least one drill parameter, controlling each of said drill, said air injection system and said water injection system, storing program steps for program control, and processing data; and said control system processing information relating to the drill parameter by determining whether the drill parameter is within a predetermined specification for at least one monitored drill parameter for a drilling phase or a retraction phase, the retraction phase following completion of the drilling phase, choosing a hole defect mitigation routine based on the at least one monitored drill parameter when the at least one drill parameter is outside the predetermined specification, said hole defect mitigation routine comprising at least one drilling phase defect mitigation routine for implementation during the drilling phase, said drilling phase defect mitigation routine comprising at least one selected from the group consisting of rotary stall protection, end-of-hole spin-out, and end-of-hole water control, and at least one retraction phase mitigation routine for implementation during the retraction phase, said control system controlling said drill rig to implement said end-of-hole spin-out routine after the borehole has been drilled when said monitored number of drill retractions during the drilling phase is outside a predetermined specification for number of drill retractions, said end-of-hole spin-out routine comprising:

retracting the drill bit to a position above a bottom of the borehole;

after the retracting, rotating the drill bit at the position for a spin-out period if the drill bit was retracted two or fewer times during the drilling phase;

after the retracting, rotating the drill bit at the position for a product of the spin-out period and the number of drill retractions if the drill bit was retracted three or more times during the drilling phase; and retracting the drill bit from the borehole.

3. A system for drilling a borehole, comprising:

a drill rig comprising a drill including a drill bit, an air injection system, and a water injection system; and a control system operatively associated with said drill rig, said control system:

monitoring drill parameters comprising drill rotational speed, drill torque, drill depth, hoist speed and number of drill retractions;

receiving information from said drill rig relating to at least one drill parameter, controlling each of said drill, said air injection system and said water injection system, storing program steps for program control, and processing data; and said control system processing information relating to the drill parameter, determining whether the drill parameter is within a predetermined specification for at least one monitored drill parameter for a drilling phase or a retraction phase, the retraction phase following completion of the drilling phase, choosing a hole defect mitigation routine based on the at least one monitored drill parameter when the at least one drill parameter is outside the predetermined specification, said hole defect mitigation routine comprising at least one drilling phase defect mitigation routine for implementation during the drilling phase and at least one retraction phase mitigation routine for implementation during the retraction phase, said refraction phase mitigation routine comprising one or more selected from the group consisting of drill bit hang-up protection, torque monitoring and hole clean-out, said control system controlling said drill rig to implement said hole clean-out routine when one or more of said monitored drill retractions is outside a predetermined specification for drill retractions, said monitored hoist speed is outside a predetermined specification for hoist speed, and said drill torque is outside a predetermined specification for drill torque, said hole clean-out routine, comprising:

lowering the drill bit to a position above a bottom of the borehole;

rotating the drill bit for a spin-out period if the drill bit was retracted two or fewer times during the drilling phase;

rotating the drill bit for a product of the spin-out period and the number of drill retractions if the drill bit was retracted at least 3 times during the drilling phase; and retracting the drill bit from the borehole.

4. A method for drilling a borehole, comprising:

monitoring one or more drill parameters comprising drill rotational speed, drill depth, hoist speed or number of drill retractions during a drilling phase and a retraction phase, the retraction phase beginning after the borehole has been drilled or after performing an end-of-hole measurement routine, said end-of-hole measurement routine being performed when said monitored drill depth meets a predetermined borehole depth and comprising:

lowering a drill bit to a position above a bottom of the borehole;

rotating the drill bit for a spin-out period if the drill bit was retracted two or fewer times during the drilling phase;

rotating the drill bit for a product of the spin-out period and the number of drill retractions if the drill bit was retracted at least 3 times during the drilling phase; and retracting the drill bit from the borehole;

using the monitored drill parameter to draw a conclusion about a borehole characteristic;

choosing a defect mitigation routine based on the borehole characteristic; and implementing the defect mitigation routine.

* * * * *